US011774873B2

(12) United States Patent
Kase et al.

(10) Patent No.: US 11,774,873 B2
(45) Date of Patent: Oct. 3, 2023

(54) IMAGE FORMING APPARATUS CALCULATING A COMPLEX NUMBER OF A DISCHARGE CURRENT WAVEFORM FOR DETERMINING A VALUE OF THE AC CHARGING VOLTAGE

(71) Applicant: CANON KABUSHIKI KAISHA, Tokyo (JP)

(72) Inventors: Takashi Kase, Tokyo (JP); Ryosuke Imaizumi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/733,297

(22) Filed: Apr. 29, 2022

(65) Prior Publication Data

US 2022/0390877 A1 Dec. 8, 2022

(30) Foreign Application Priority Data

Jun. 2, 2021 (JP) ..... 2021-093313

(51) Int. Cl.
*G03G 15/02* (2006.01)

(52) U.S. Cl.
CPC ..... *G03G 15/0266* (2013.01); *G03G 15/0283* (2013.01)

(58) Field of Classification Search
CPC ..... G03G 15/0266; G03G 15/0283
See application file for complete search history.

(56) References Cited

U.S. PATENT DOCUMENTS

| | | | | |
|---|---|---|---|---|
| 9,429,865 | B2 * | 8/2016 | Kidaka | G03G 15/0283 |
| 9,507,286 | B2 | 11/2016 | Shirakata et al. | |
| 9,904,200 | B2 * | 2/2018 | Kidaka | G03G 15/0266 |
| 10,353,331 | B2 * | 7/2019 | Takagami | G03G 15/5037 |

FOREIGN PATENT DOCUMENTS

| | | | |
|---|---|---|---|
| JP | 3576738 | B2 | 10/2004 |
| JP | 2014-106459 | A | 6/2014 |
| JP | 2017-167429 | A | 9/2017 |

* cited by examiner

*Primary Examiner* — Arlene Heredia
(74) *Attorney, Agent, or Firm* — Venable LLP

(57) ABSTRACT

An image forming apparatus executes processing for calculating a complex number of a discharge current waveform which is a discharge current component of a current waveform in discharge based on a first complex number at an analyzing frequency near a charging frequency of a current waveform in non-discharge, a second complex number at the analyzing frequency of the current waveform in non-discharge, a third complex number at an analyzing frequency of the current waveform in discharge, and a fourth complex number at the analyzing frequency of the current waveform in discharge, and then for determining an AC voltage value of a charging voltage during image formation based on a calculation result of the complex number of the discharge current waveform. The controller controls a power supply portion to apply, to the charging member, the charging voltage including an AC voltage component with the determined value.

17 Claims, 13 Drawing Sheets

(a)

(b)

IMAGE FORMING APPARATUS CALCULATING A COMPLEX NUMBER OF A DISCHARGE CURRENT WAVEFORM FOR DETERMINING A VALUE OF THE AC CHARGING VOLTAGE

FIELD OF THE INVENTION AND RELATED ART

The present invention relates to an image forming apparatus, such as a copying machine, a printer, a facsimile device, a printing device, or a multi-function machine having a plurality of functions of the foregoing machines, of an electrophotographic type.

In the image forming apparatus of the electrophotographic type, a surface of a photosensitive member is electrically charged and then the surface of the photosensitive member is exposed to light in accordance with image information, whereby an electrostatic latent image is formed on the photosensitive member. Further, the electrostatic latent image formed on the photosensitive member is developed with toner to form a toner image on the photosensitive member, and then the toner image formed on the photosensitive member is transferred onto a recording material directly or via an intermediary transfer member. Then, the recording material on which the toner image is transferred is heated and pressed, so that the toner image is fixed on the recording material.

In recent years, as a charging means for charging the photosensitive member, from a viewpoint of advantages such as low ozone and low electric power, a charging device for charging the photosensitive member under application of a charging voltage to a charging member by causing the charging member to be in contact with or in proximity to the surface of the photosensitive member has been widely used.

As a charging type of such a charging device, there is a "DC voltage charging type" in which the photosensitive member is charged by applying only a DC voltage to the charging member. Further, there is an "AC voltage charging type" in which the photosensitive member is charged by applying, to the charging member, an oscillating voltage which is in a superimposed form including an AC voltage component and a DC voltage component and which is periodically changed in voltage value with a time. In recent years, the "AC voltage charging type" excellent in charging uniformity has been widely used.

In the AC voltage charging type, with respect to a surface potential of the photosensitive member, positive and negative voltages are alternately applied, so that negative discharge and positive discharge ("AC discharge") are repeated, and therefore, a deterioration of the surface of the photosensitive member is liable to progress due to the discharge in some instances. Further, a deteriorated portion of the surface of the photosensitive member is abraded and worn by friction with a contact member such as a cleaning blade contacting the photosensitive member in some instances. That is, when a discharge amount becomes large, there is a possibility that the photosensitive member surface is abraded in a large amount and thus an image defect becomes liable to occur and leakage from the charging member to the photosensitive member becomes liable to occur in a small amount of use of the photosensitive member (i.e., the number of sheets for image formation). On the other hand, it is known that the surface potential of the photosensitive member is made uniform by discharge on a side opposite to a charge polarity of the photosensitive member ("reverse discharge") (positive discharge in the case where the charge polarity of the photosensitive member is the negative polarity), and therefore, the reverse discharge to the extent that the surface of the photosensitive member is uniformly charged is needed. As the reverse discharge becomes strong, discharge on the charging polarity side of the photosensitive member (i.e., negative discharge in the case where the charging polarity of the photosensitive member is the negative polarity) also becomes strong, so that a reverse discharge amount and a total discharge amount correlate to each other and therefore in order to uniformly charge the photosensitive drum surface, a discharge amount of not less than a certain threshold is needed.

As described above, as regards a discharge current amount in the AC voltage charging type, surface abrasion of the photosensitive member is liable to occur when the discharge current amount is excessively large, and it becomes difficult to uniformly discharge the photosensitive drum surface when the discharge current amount is excessively small.

Therefore, a method in which the discharge current amount is detected and a charging voltage (particularly an AC voltage value) during image formation is set has been proposed (Japanese Patent No. 3576738). In this method, the discharge current amount is calculated and the setting of the charging voltage during the image formation is made by performing the following processing. First, a plurality of alternating current amounts for AC voltages for detection in a non-discharge region are detected, so that a voltage-current proportional expression (approximate straight line) of an AC component of an alternating current (AC) flowing through a charging nip (contact portion between the charging member and the photosensitive member) is acquired. Then, a total AC amount for a predetermined AC voltage in a discharge region is detected, and an AC discharge current amount for the predetermined AC voltage is acquired by subtracting an AC amount, calculated by the above-described proportional expression, from the total AC amount. Then, depending on the acquired AC discharge current amount, setting of a proper charging voltage during the image formation is made (determined) so that the AC discharge current amount during the image formation becomes a proper value. Such processing is performed in a period in which the charging member corresponds to a non-image forming region on the photosensitive member, and when the charging member corresponds to an image forming region, the charging voltage is controlled in the setting determined by the above-described processing.

However, in the conventional method as described above, in some instances, it becomes difficult to set the charging voltage (particularly the AC voltage value) during the image formation at a proper value with accuracy. That is, in the above-described method, when the voltage-current proportional expression of the AC component in the non-discharge region is acquired, a detection result of the AC amount fluctuates due to the influence of noise or the like in some instances. Then, the proportional expression (approximate straight line) is acquired on the basis of the detection result of the AC amount, so that a detection error of the AC amount is amplified. When the discharge current amount is acquired on the basis of the proportional expression, the discharge current amount cannot be extracted with accuracy in some instances.

SUMMARY OF THE INVENTION

A principal object of the present invention is to provide an image forming apparatus capable of setting a proper charging voltage for image formation.

According to an aspect of the present invention, there is provided an image forming apparatus comprising: an image bearing member; a charging member provided in contact with or in a neighborhood of a surface-to-be-charged of the image bearing member; a power source portion configured to apply, to the charging member during image formation, a charging voltage which is a superimposed oscillating voltage including a DC voltage and an AC voltage and having a predetermined charging frequency; a waveform acquiring portion configured to acquire a current waveform of a current flowing through the charging member when the power source portion applies the charging voltage to the charging member and a voltage waveform of the charging voltage applied to the charging member by the power source portion; a processing portion configured to perform operation processing on the basis of the current waveform and the voltage waveform which are acquired by the waveform acquiring portion; and a controller configured to control the power source portion, wherein the controller executes processing for calculating a first complex number at an analyzing frequency in a neighborhood of the charging frequency of a current waveform in non-discharge and a second complex number at the analyzing frequency of a voltage waveform in non-discharge by executing first acquiring control for acquiring the current waveform in non-discharge and the voltage waveform in non-discharge under application of the oscillating voltage in which the DC voltage and the AC voltage are set so as not to exceed a discharge start voltage and by subjecting each of the current waveform in non-discharge and the voltage waveform in non-discharge to fast Fourier transformation, processing for calculating a third complex number at the analyzing frequency of a current waveform in discharge and a fourth complex number at the analyzing frequency of a voltage waveform in discharge by executing second acquiring control for acquiring the current waveform in discharge an the voltage waveform in discharge under application of the oscillating voltage in which the DC voltage and the AC voltage are set so as to exceed a discharge start voltage and by subjecting each of the current waveform in discharge and the voltage waveform in discharge to the fast Fourier transformation, and processing for calculating a complex number of a discharge current waveform which is a discharge current component of the current waveform in discharge on the basis of the first complex number, the second complex number, the third complex number, and the fourth complex number, and then for determining a value of the AC voltage of the charging voltage during the image formation on the basis of a calculation result of the complex number of the discharge current waveform, and wherein the controller controls the power supply portion so as to apply, to the charging member, the charging voltage including an AC voltage component with the value determined by the processing portion.

Further features of the present invention will become apparent from the following description of exemplary embodiments with reference to the attached drawings.

Figure 4:
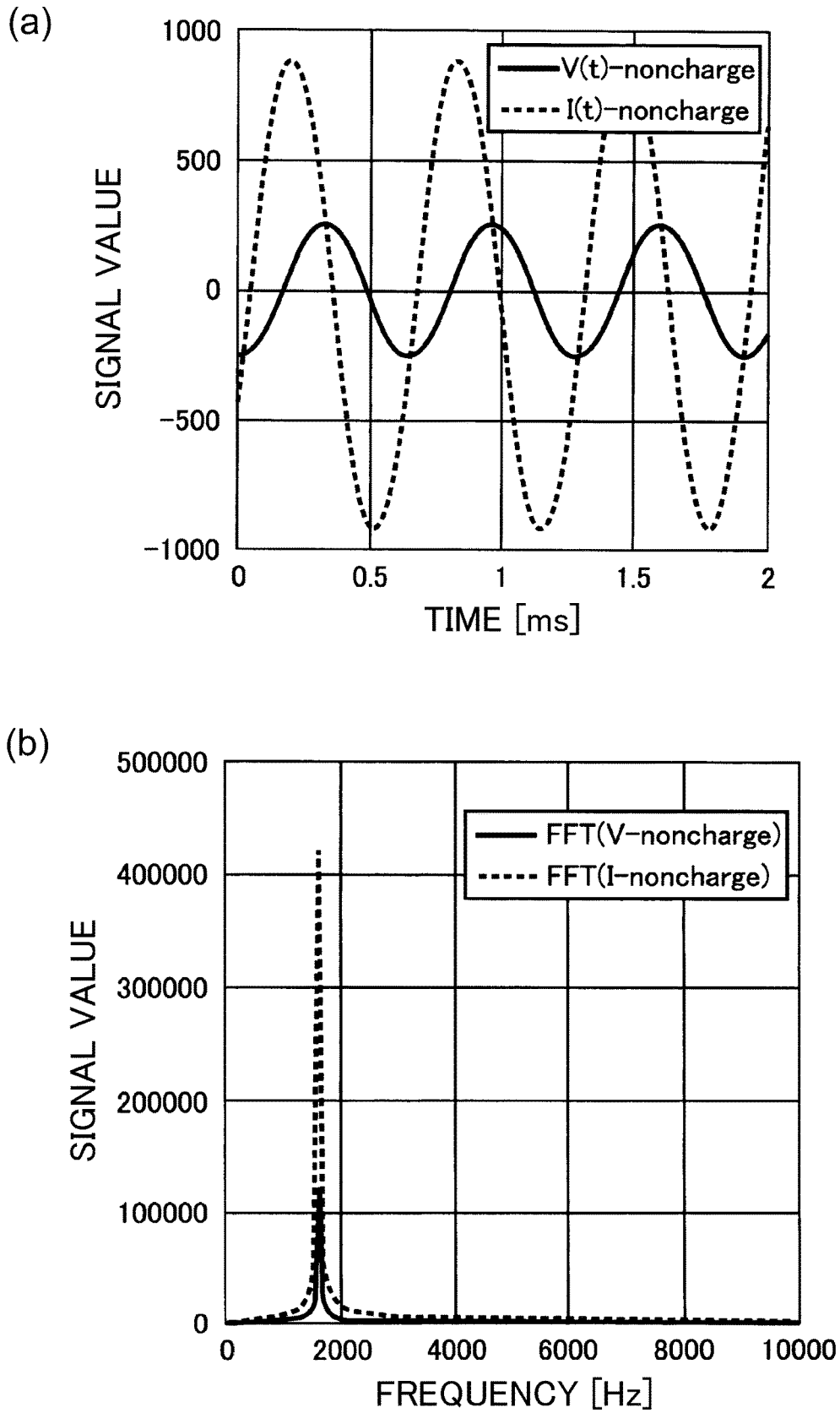

Part (a) of FIG. 4 is a graph showing a charging current waveform and a charging voltage waveform and part (b) of FIG. 4 is a graph showing a frequency characteristic of the charging current waveform, and the charging voltage waveform during non-discharge.

Figure 5:
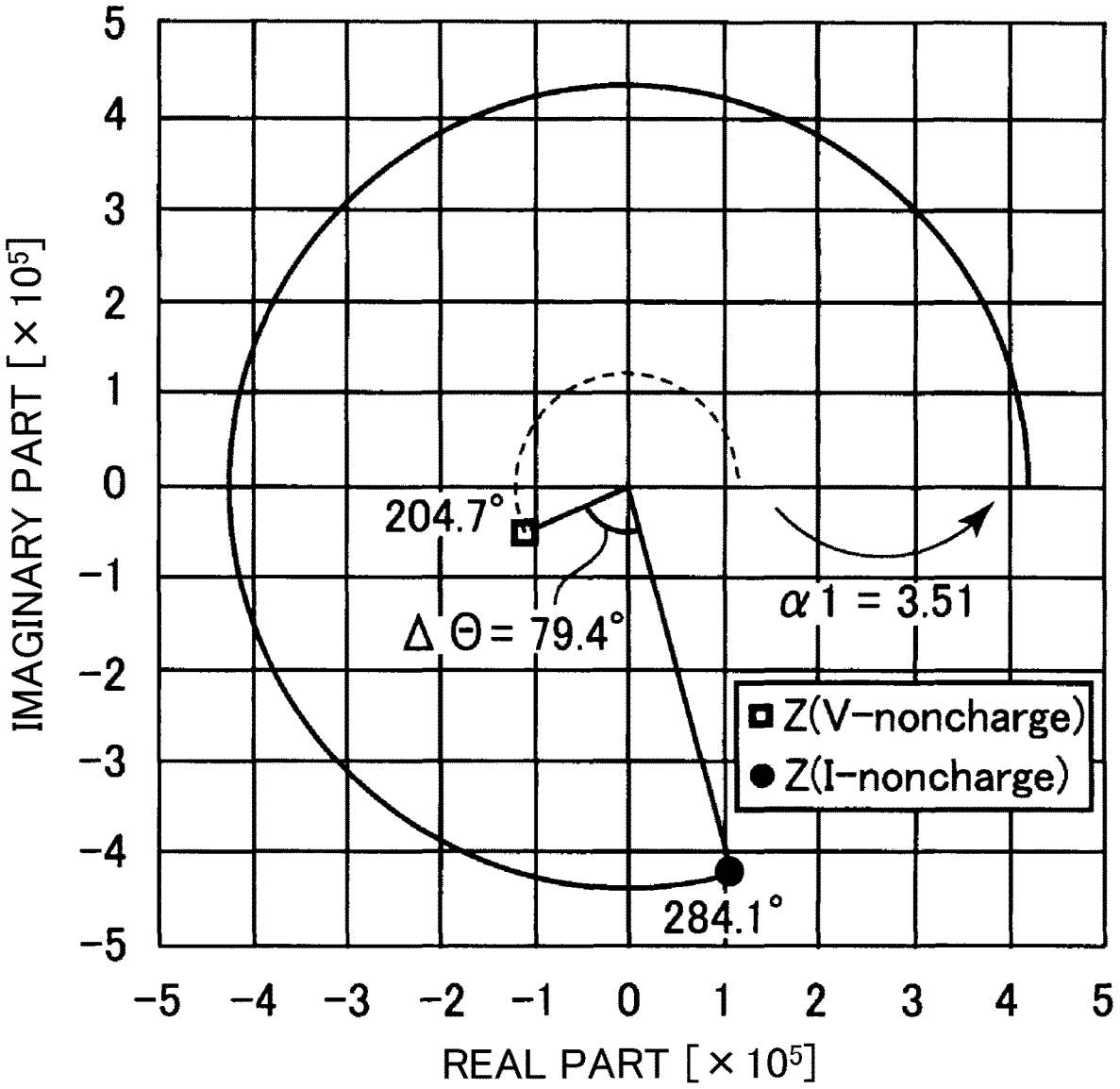

FIG. 5 is a graph showing a complex number space at an analyzing frequency in the neighborhood of a charging frequency in the frequency characteristic of the charging current waveform and the charging voltage waveform during the non-discharge.

Figure 6:
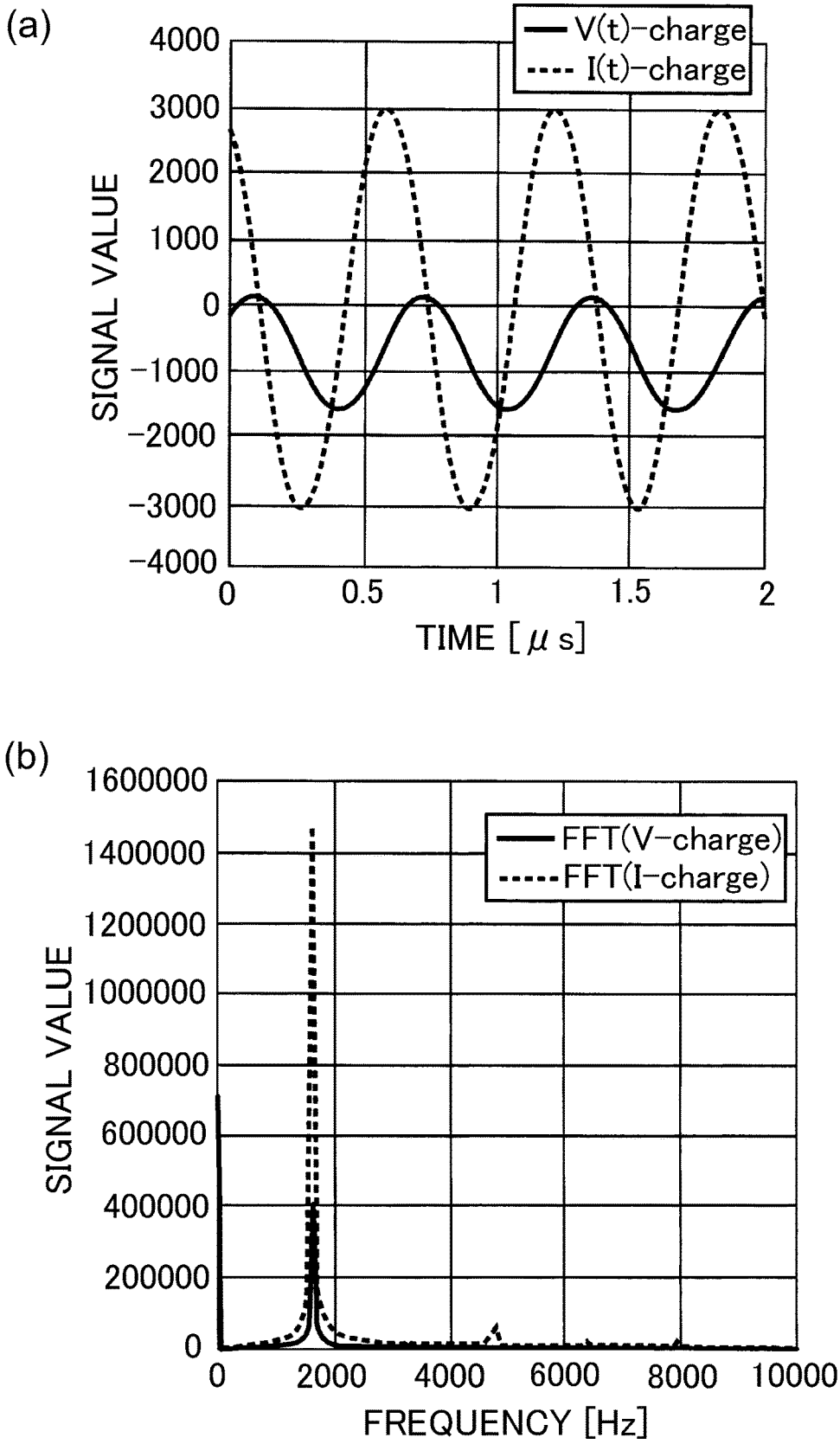

Part (a) of FIG. 6 is a graph showing a charging current waveform and a charging voltage waveform during discharge, and part (b) of FIG. 6 is a graph showing a frequency characteristic of the charging current waveform and the charging voltage waveform during discharge.

Figure 7:
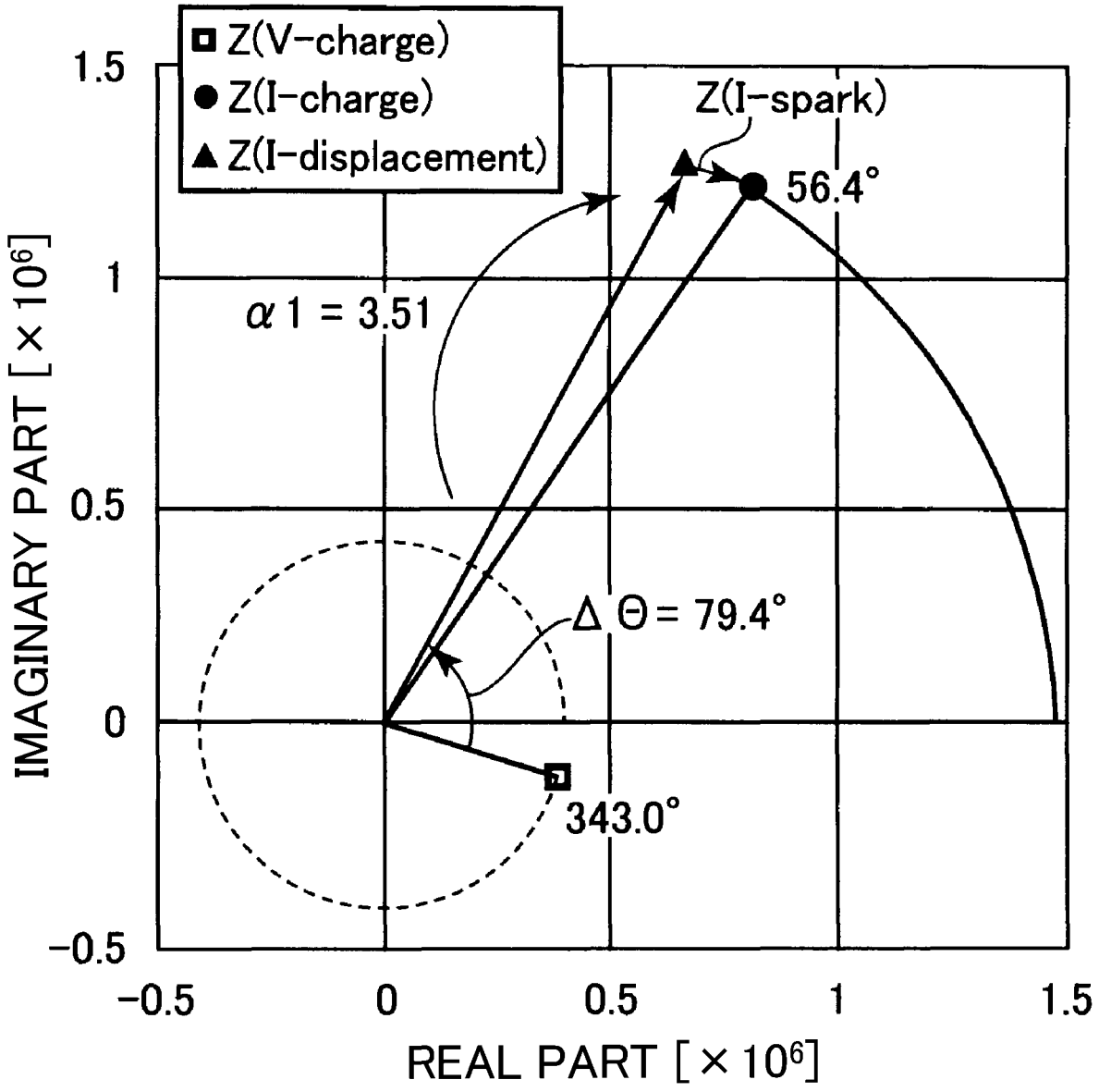

FIG. 7 is a graph showing a complex number space at an analyzing frequency in the neighborhood of a charging frequency in the frequency characteristic of the charging current waveform and the charging voltage waveform during the discharge.

Figure 8:
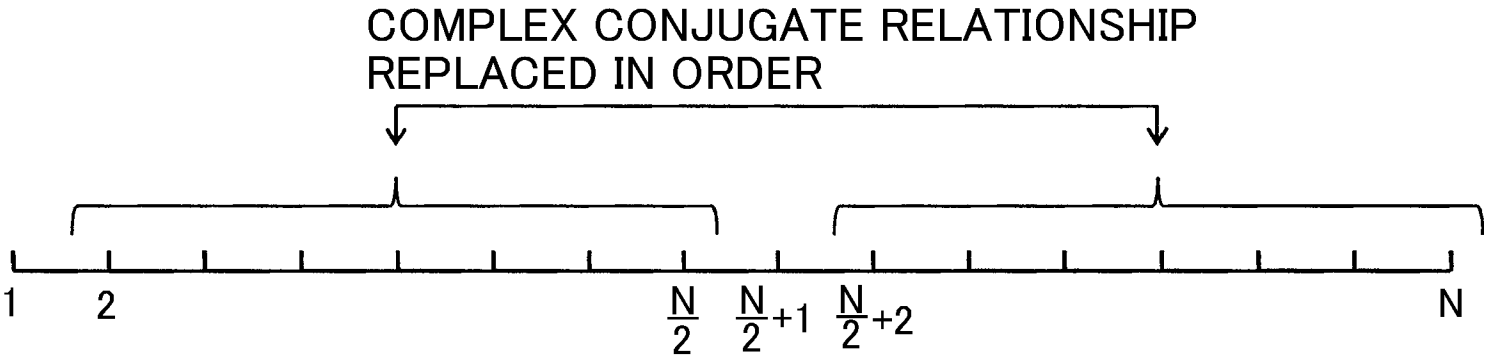

FIG. 8 is an illustration of a frequency characteristic after fast Fourier transformation.

Figure 9:
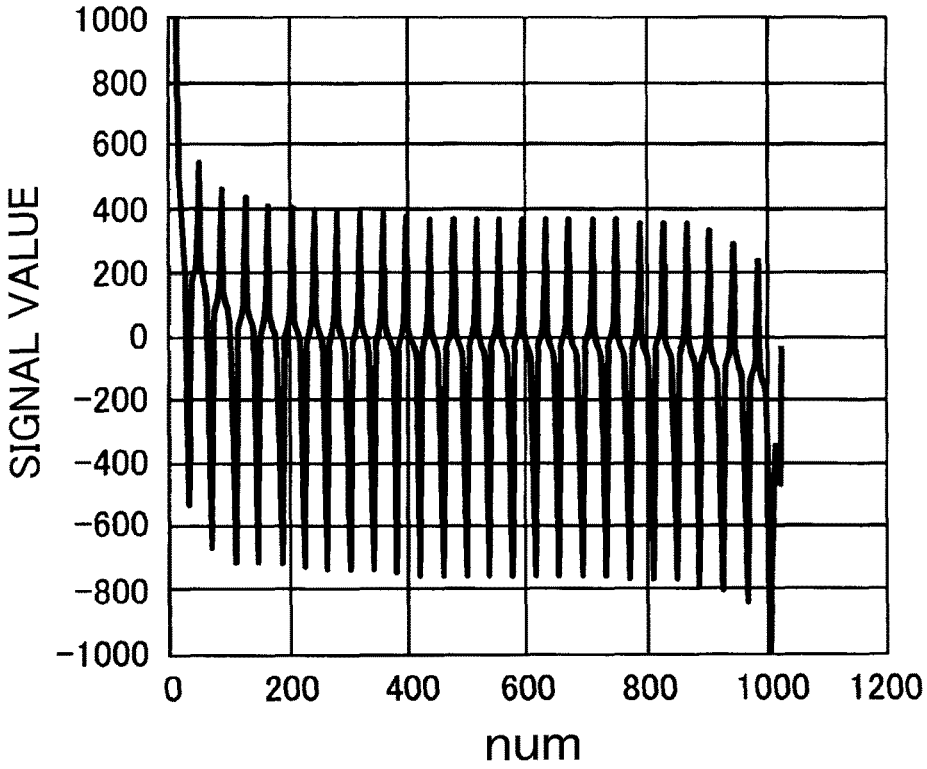
Figure 9:
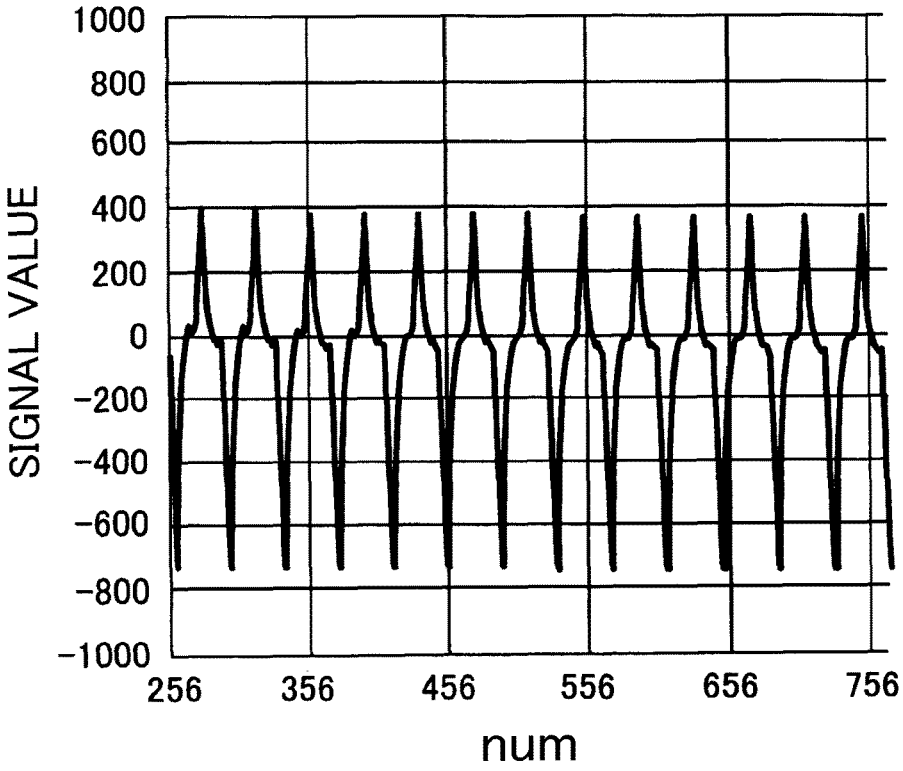

Part (a) of FIG. 9 is a graph showing a discharging current waveform, and part (b) of FIG. 9 is a graph showing a central portion of the discharging current waveform.

Figure 10:
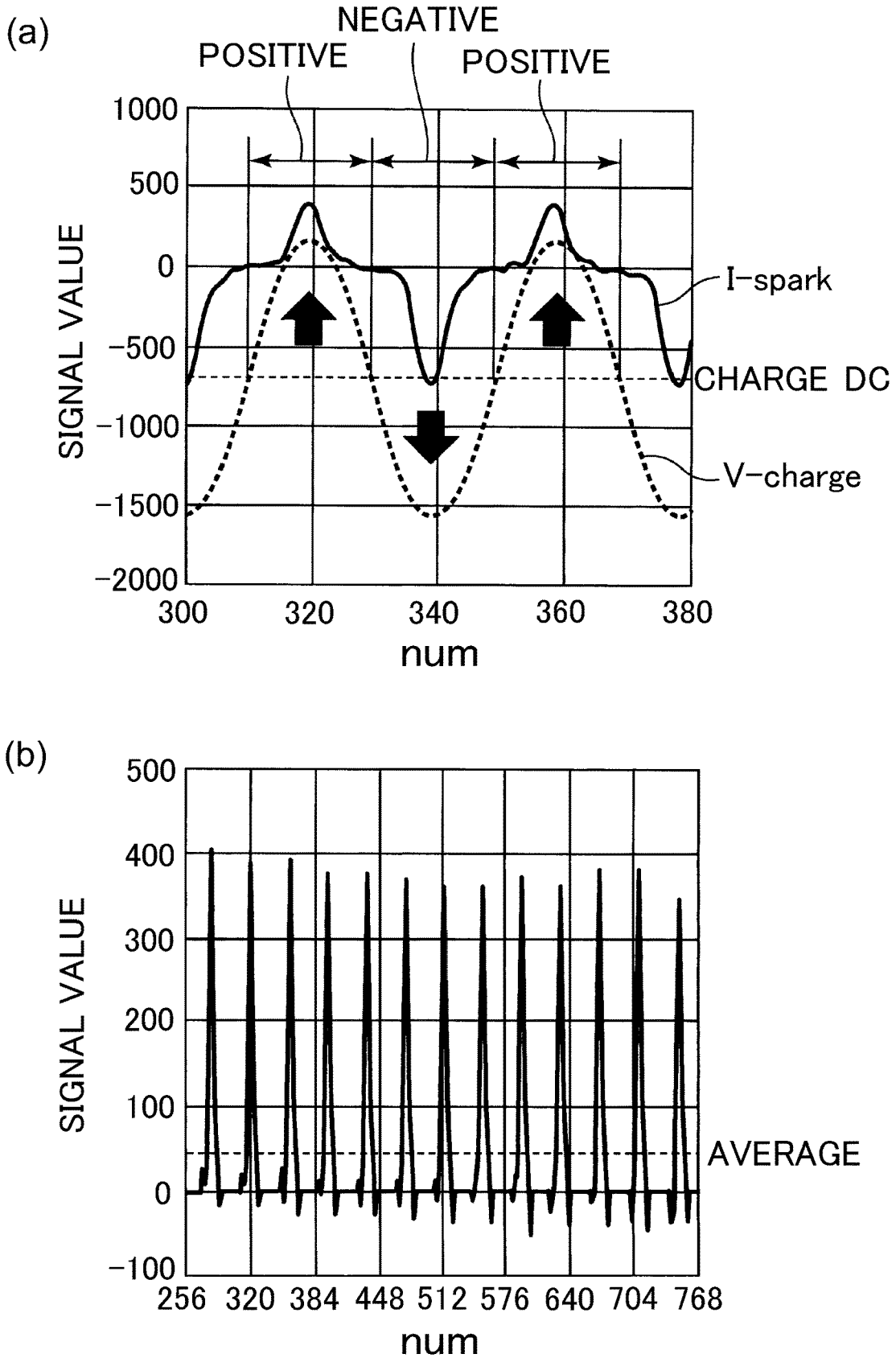

Part (a) of FIG. 10 is a graph for illustrating a timing for separating between negative discharge and positive discharge of the discharging current waveform, and part (b) of FIG. 10 is a graph showing a positive discharging current waveform.

Figure 11:
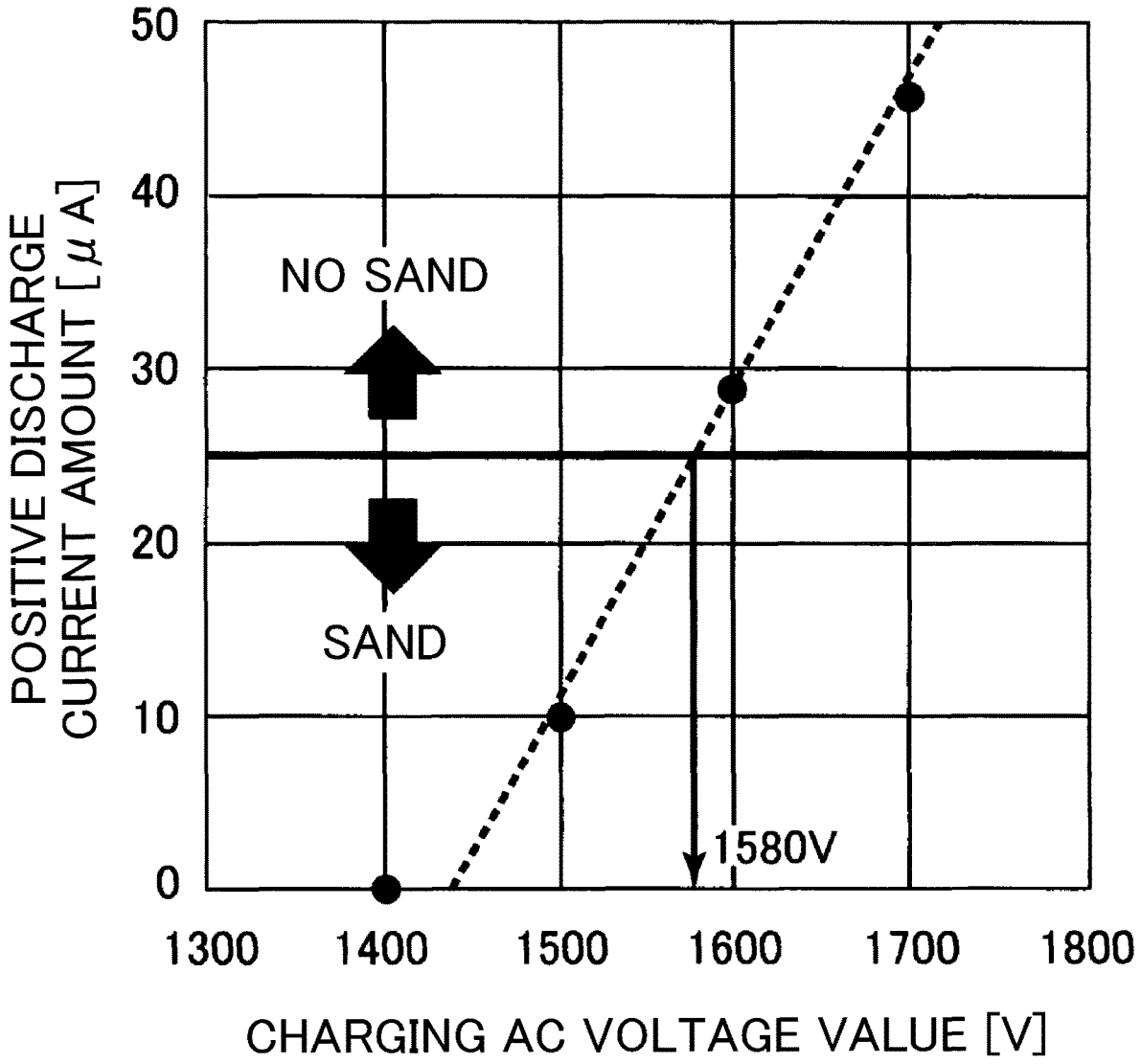

FIG. 11 is a graph showing a relationship between a charging AC voltage value and a positive discharging current amount.

Figure 12:
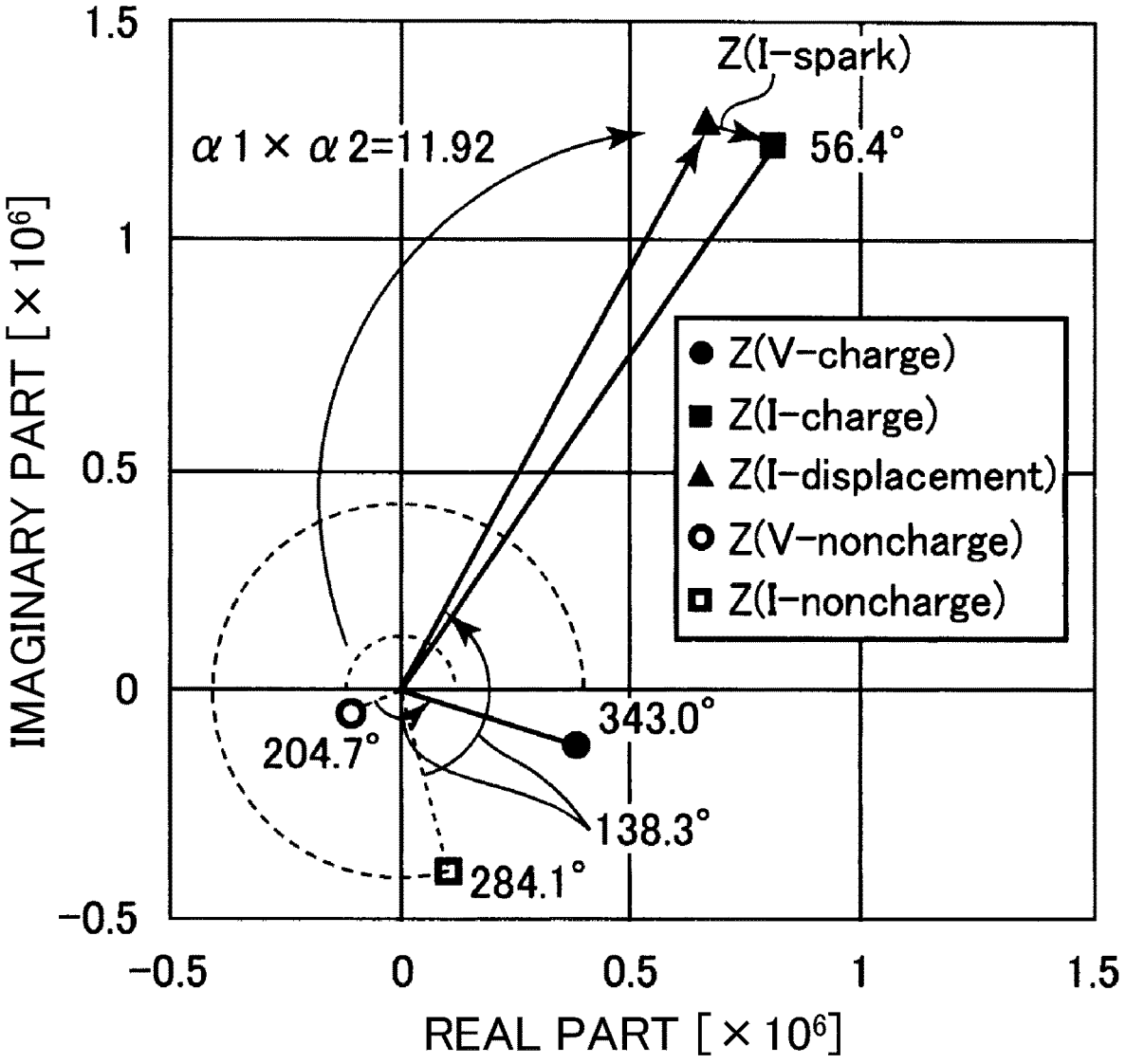

FIG. 12 is a graph showing a complex number space at an analyzing frequency in the neighborhood of a charging frequency characteristic of waveforms during the non-discharge and during the discharge in another embodiment.

Figure 13:
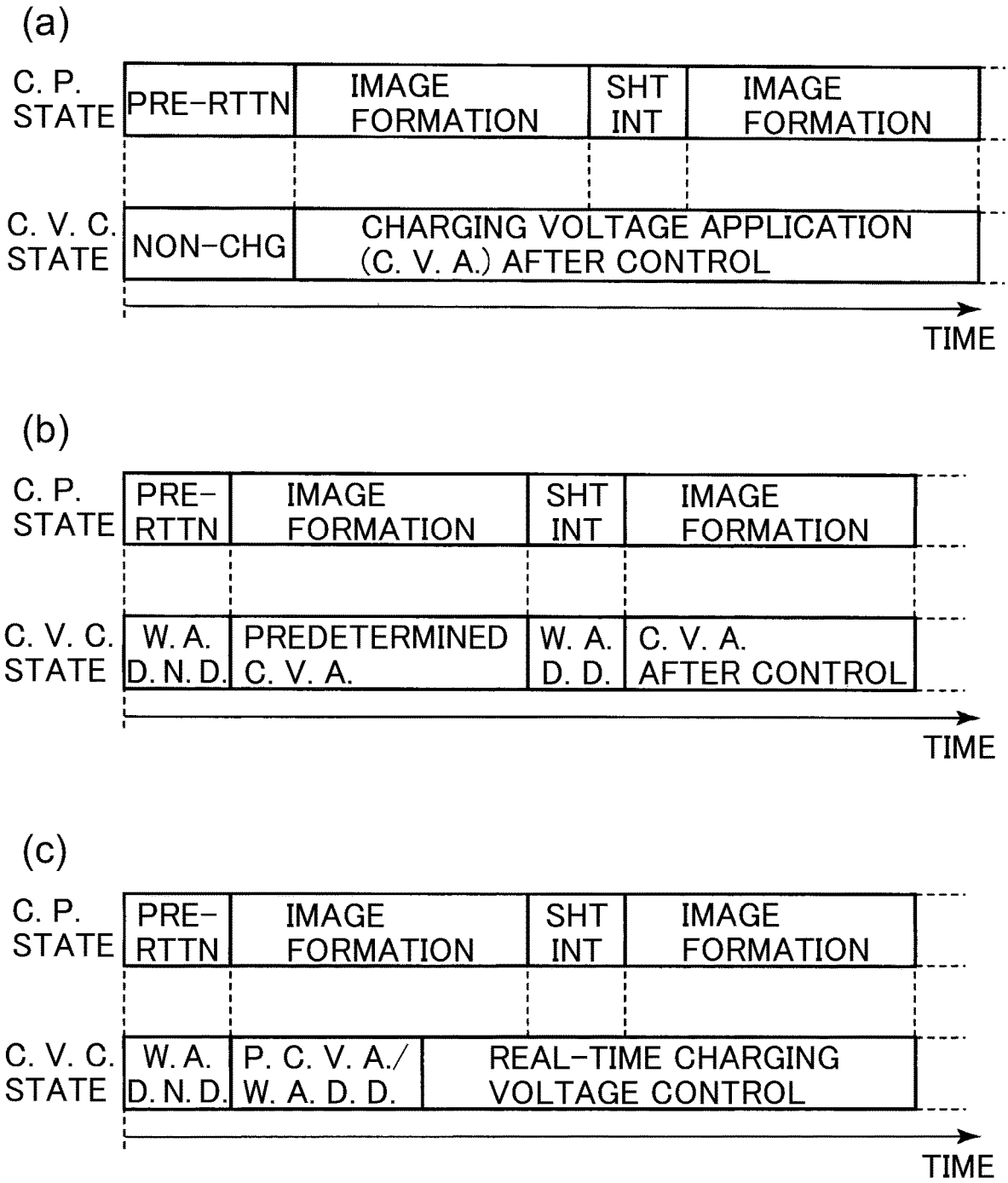

Parts (a), (b) and (c) of FIG. 13 are timing charts each for illustrating an example of an execution timing of processing of charging voltage control.

DESCRIPTION OF THE EMBODIMENTS

An image forming apparatus according to the present invention will be described specifically with reference to the drawings.

Embodiment 1

1. General Constitution of Image Forming Apparatus

Figure 1:
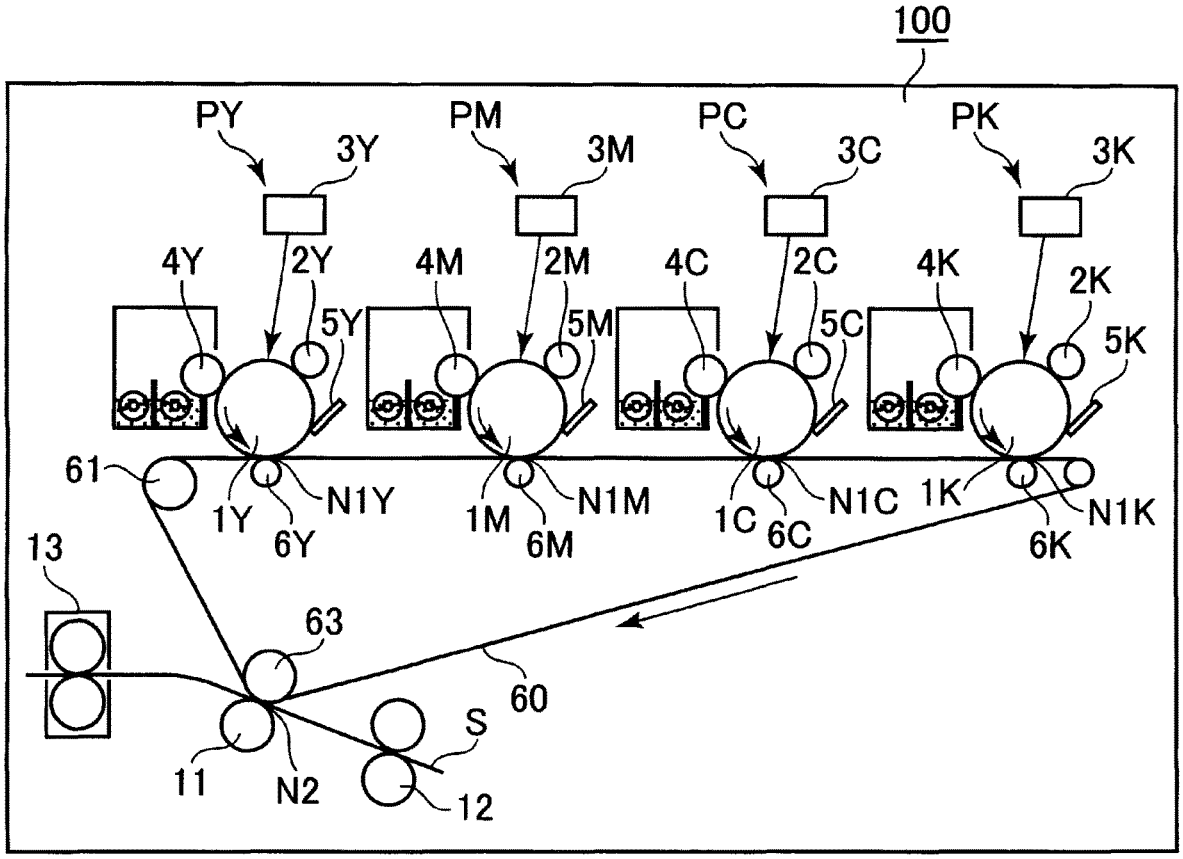
FIG. 1 is a schematic sectional view of an image forming apparatus.

FIG. 1 is a schematic sectional view of an image forming apparatus 100 of an embodiment 1 according to the present invention.

The image forming apparatus 100 of this embodiment is a tandem-type printer employing an intermediary transfer type system capable of forming a full-color image by using an electrophotographic type process.

The image forming apparatus 100 includes, as a plurality of image forming portions (stations), first to fourth image forming portions PY, PM, PC and PK for forming images of yellow (Y), magenta (M), cyan (C) and black (K), respectively. The first to fourth image forming portions PY, PM, PC and PK are arranged and disposed in a line along a movement direction of a surface of an intermediary transfer belt 60 described later onto which images are to be transferred. Elements having the same or corresponding functions and constitutions in the respective image forming portions PY, PM, PC and PK are collectively described by omitting suffixes Y, M, C and K for representing elements for associated colors in some cases.

Four color toner images formed by the first to fourth image forming portions PY, PM, PC and PK are primary-transferred superposedly onto the intermediary transfer belt 60 in primary transfer portions N1Y, N1M, N1C and N1K. The toner images primary-transferred on the intermediary transfer belt 60 are fed toward a secondary transfer portion N2 with rotation of the intermediary transfer belt 60, and then are secondary-transferred onto a recording material S. The recording material S is separated and fed one by one from a recording material accommodating portion (not shown) and is conveyed to a registration roller pair 12. The registration roller pair 12 feeds the recording material S toward the secondary transfer portion N2 so that the recording material S is timed to the toner images on the intermediary transfer belt 60.

The recording material S on which the toner images are secondary-transferred is conveyed to a fixing device 13. The fixing device 13 heats and fixes the recording material S carrying unfixed toner images, and fixes (melts and sticks) the toner images on a surface of the recording material S. Thereafter, the recording material S on which the toner images are fixed is discharged (outputted) to an outside of an apparatus main assembly of the image forming apparatus 100.

Incidentally, the image forming apparatus 100 is capable of forming and outputting a single or multi-color image by using a single image forming portion P or a plurality of image forming portions P.

2. General structure of image forming portion.

Figure 2:
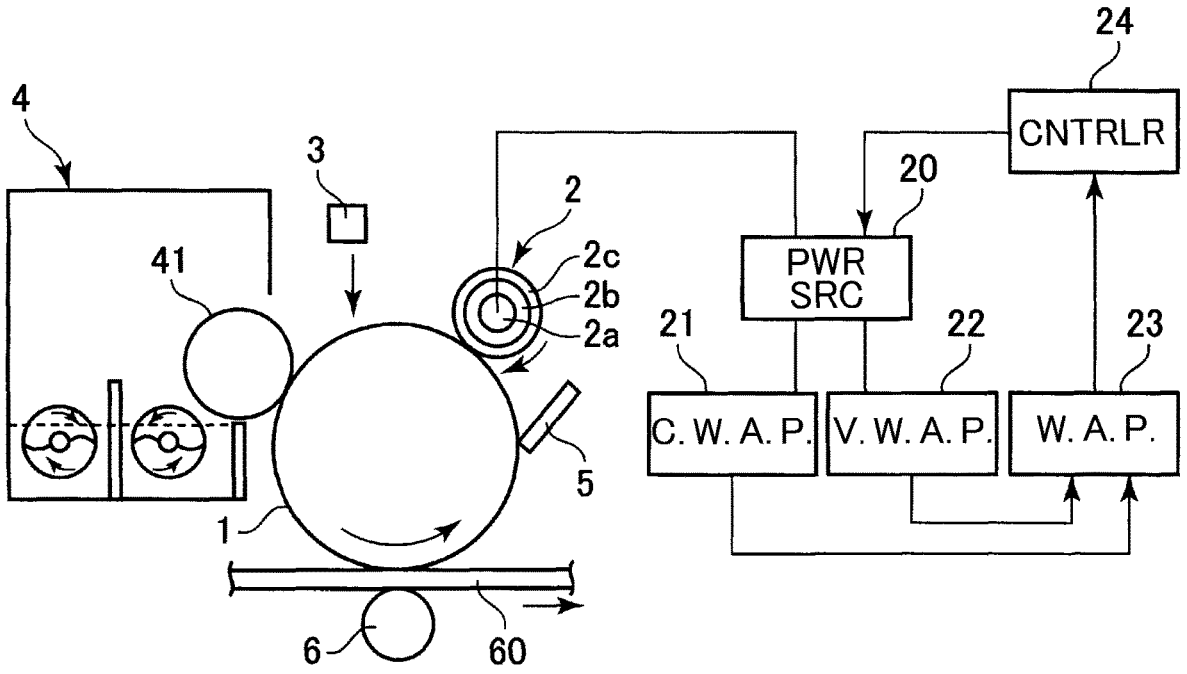
FIG. 2 is a schematic view showing a constitution of an image forming portion and a charging controller.

FIG. 2 is a schematic view showing a structure of the image forming portion and a constitution of a charge controller. In this embodiment, structures of the image forming portions PY, PM, PC and PK are substantially the same except for colors of toners used in developing devices 4, and therefore, a single image forming portion P will be described as a representative image forming portion.

The image forming portion P includes the photosensitive drum 1 which is a rotatable drum-shaped (cylindrical) photosensitive member (electrophotographic photosensitive member) as an image bearing member. Further, the image forming portion P includes, at a periphery of the photosensitive drum 1, a charging roller 2 which is a roller-shaped charging member as a charging means, an exposure device (laser scanner) 3 as an exposure means, the developing device 4 as a developing means, a cleaning blade 5 as a cleaning means, and a primary transfer roller 6 which is a roller-shaped primary transfer member as a primary transfer means.

During image formation, the photosensitive drum 1 is rotationally driven in the counterclockwise direction in FIGS. 1 and 2. In this embodiment, a predetermined peripheral speed (process speed) of the photosensitive drum 1 is 320 mm/s. A surface of the rotating photosensitive drum 1 is electrically charged uniformly to a predetermined polarity (negative in this embodiment) and a predetermined potential by the charging roller 2. During a charging process, to the charging roller 2, as a charging voltage (charging bias), an oscillating voltage in a superimposed form including an AC voltage component and a DC voltage component is applied. The charged surface of the charged photosensitive drum 1 is subjected to scanning exposure to light by the exposure device, so that an electrostatic latent image (electrostatic image) in accordance with image information is formed on the photosensitive drum 1. The electrostatic latent image formed on the photosensitive drum 1 is developed (visualized) with toner as a developer supplied by the developing device 4, so that the toner image is formed on the photosensitive drum 1. In this embodiment, the toner charged to the same polarity (negative polarity in this embodiment) as a charge polarity of the photosensitive drum 1 is deposited on an exposed portion (image portion), on the photosensitive drum 1, where an absolute value of a potential is lowered by subjecting the surface of the photosensitive drum 1 to the exposure to light after uniformly charging the surface of the photosensitive drum 1. In this embodiment, a normal toner charge polarity which is the toner charge polarity during development is the negative polarity. During the development, to a developing sleeve 41 as a developer carrying member included in the developing device 4, as a developing voltage (developing bias), an oscillating voltage in a superimposed form including an AC voltage component and a DC voltage component is applied.

The intermediary transfer belt 60 constituted by an endless belt as an intermediary transfer member is provided so as to oppose the four photosensitive drums 1. The intermediary transfer belt 60 is stretched by a driving roller 61, a tension roller 62 and an inner secondary transfer roller 63 which are used as a plurality of stretching rollers (supporting rollers). The intermediary transfer belt 60 is rotated (circulated) by rotationally driving the driving roller 61 in the clockwise direction in FIG. 1. On an inner peripheral surface side of the intermediary transfer belt 60, the primary transfer rollers 6Y, 6M, 6C and 6K are provided correspondingly to the photosensitive drums 1Y, 1M, 1C and 1K, respectively. The primary transfer roller 6 is pressed (urged) against the intermediary transfer belt 60 toward the photosensitive drum 1, so that a primary transfer portion N1 where the photosensitive drum 1 and the intermediary transfer belt 60 contact each other is formed.

Further, at a position opposing the inner secondary transfer roller 63 on an outer peripheral surface side of the intermediary transfer belt 60, another secondary transfer roller 11 which is a roller-type secondary transfer member as a secondary transfer means is provided. The outer secondary transfer roller 11 is pressed (urged) against the intermediary transfer belt 60 toward the inner secondary transfer opposite roller 63 and forms a secondary transfer portion N2 where the intermediary transfer belt 60 and the outer secondary transfer roller 11 are in contact with each other. As described above, the toner images are primary-transferred from the photosensitive drums 1 onto the intermediary transfer belt 60 at the primary transfer portions N1, and then are secondary-transferred from the intermediary transfer belt 60 onto the outer secondary transfer roller 8 in the secondary transfer portion N2. During the primary transfer, to each of the primary transfer rollers 6, a primary transfer voltage (primary transfer bias) which is a DC voltage of the opposite polarity to the normal charge polarity of the toner is applied. During the secondary transfer to the outer secondary transfer roller 11, a secondary transfer voltage (secondary transfer bias) which is a DC voltage of the opposite polarity to the normal charge polarity of the toner is applied.

Further, toner remaining on the photosensitive drum 1 after the primary transfer is removed and collected from the surface of the photosensitive drum 1 by the cleaning device 5.

Here, in this embodiment, to the primary transfer roller 6, the primary transfer voltage subjected to constant-voltage control is applied so that a current of −12 μA flows through the primary transfer roller 6 when a solid white image portion is in the primary transfer portion N1.

Further, in this embodiment, as the intermediary transfer belt 60, a belt which is $10^{10}$ (Ω·cm) in volume resistivity ρv and $10^{8}$ (Ω) in surface resistivity ρs and which is made of polyether ether ketone was used. The volume resistivity ρv of the intermediary transfer belt 60 may preferably be $10^{8}$ (Ω·cm) to $10^{12}$ (Ω·cm), and the surface resistivity ρs may preferably be $10^{8}$ (Ω) to $10^{13}$ (Ω). As a material thereof, polyether ether ketone or polyimide is generally used.

Further, in this embodiment, the charging roller 2 includes a core metal 2*a*, a base layer 2*b* formed on the core metal 2*a*, and a surface layer 2*c* formed on the base layer 2*b*. As the core metal 2*a*, chromium-plated iron is used, and as the base layer, a Hydrin® rubber is used. As the surface layer 2*c*, a nylon resin-based material is used. The surface layer 2*c* of the charging roller 2 was prepared by mixing paint containing nylon resin particles and then by coating the paint on the base layer 2*b*. Incidentally, the materials and a manufacturing method of the charging roller 2 are not limited to those described above, but general-purpose rubber and resin materials can be used. Further, in this embodiment, as the charging roller 2, a rubber roller which is 12 mm in outer diameter, $10^{5}$ (Ω·cm) in volume resistivity, and 66° (JIS-A) in hardness was used. Further, in this embodiment, the charging roller 2 has surface roughness of 15 μm in Rz and 100 μm in Sm. Further, in this embodiment, the charging roller 2 is contacted to the photosensitive drum 1 with a predetermined pressing force, and forms a charging nip (contact portion between the charging roller 2 and the photosensitive drum 1).

During the image formation, to the charging roller 2, a charging voltage which is an oscillating voltage in a superimposed form including an AC voltage component ("charging AC voltage") and a DC voltage component ("charging DC voltage") is applied. Then, an alternating current (AC) flows through the charging nip, and at the same time, electric discharge (AC discharge) occurs in at least one of gaps formed between the charging roller 2 and the photosensitive drum 1 on an upstream side and a downstream side of the charging nip with respect to a surface movement direction of the photosensitive drum 1. By this, the surface of the photosensitive drum 1 is charged so that a charge potential converges to a charging DC voltage value.

Here, the image forming apparatus 100 performs a job (image output operation, print job) which is a series of operations which are started by a single start instruction and in which an image is formed on a single recording material S or on a plurality of recording materials S and then the recording materials S are outputted. The job generally includes an image forming step, a pre-rotation step, a sheet interval step in the case where the images are formed on the plurality of the recording materials S, and a post-rotation step. The image forming step is a period in which formation of the electrostatic latent image for an image formed and outputted on the recording material S, formation of the toner image, and primary transfer and secondary transfer of the toner image are actually performed, and "during image formation (image forming period)" refers to this period. Specifically, at each of positions where steps of effecting the formation of the electrostatic latent image, the formation of the toner image, and the primary transfer and the secondary transfer of the toner image, timing during image formation is different. The pre-rotation step is a period in which a preparatory operation, from input of the start instruction until the image formation is actually started, before the image forming step is performed. The sheet interval step (recording material voltage step) is a period corresponding to an interval between a recording material S and a subsequent recording material S when the image formation is continuously performed (continuous image formation) with respect to the plurality of transfer materials P. The post-rotation step is a period in which a post-operation (preparatory operation) after the image forming step is performed. "During non-image formation (non-image formation period)" refers to a period other than "during image formation", and includes the pre-rotation step, the sheet interval step, the post-rotation step and further includes a pre-multi-rotation step which is a preparatory operation during main switch actuation of the image forming apparatus 100 or during restoration from a sleep state.

3. Charging Voltage Control (Discharge Current Amount Control)

Next, charging voltage control (discharge current amount control) in this embodiment will be described. In this embodiment, constitutions and operations relating to the charging voltage control for the image forming portions PY, PM, PC and PK are substantially the same, and therefore, those for a single image forming portion P will be described as an example.

<Constitution>

In this embodiment, the image forming apparatus 100 includes a power source portion 20 for applying the voltage to the charging roller 2. The image forming apparatus 100 further includes a current waveform acquiring portion 21 for acquiring a current waveform of a current flowing from the power source portion 20 into the charging roller 2 and a voltage waveform acquiring portion 22 for acquiring a voltage waveform applied from the power source portion 20 to the charging roller 2. Further, the image forming apparatus 100 includes a waveform analyzing portion 23 as a processing portion for determining setting of a proper charging voltage (particularly an AC voltage value) during image formation by subjecting the current waveform and the voltage waveform which are acquired by the current waveform acquiring portion 21 and the voltage waveform acquiring portion 22, respectively, to Fourier analysis. Further, the image forming apparatus 100 includes a controller 24 for controlling the power source portion 20 so as to output the charging voltage determined by the waveform analyzing portion 23.

The current waveform acquiring portion 21 is constituted by including a current detecting portion (ammeter) and a storing portion for storing a current value (current waveform). Further, the voltage waveform acquiring portion 22 is complex numbered by including a voltage detecting portion (voltmeter) and a storing portion for storing a voltage value (voltage waveform). The current waveform acquiring portion 21 and the voltage waveform acquiring portion 22 acquire the current value (current waveform) and the voltage value (voltage waveform), respectively. Each of the waveform analyzing portion 23 and the controller 24 is constituted by including an arithmetic (operation) processing portion and a storing portion, and the operation processing portion executes processing in accordance with a program stored in the storing portion and thus realizes an associated function. In this embodiment, the current waveform acquiring portion 21, the voltage waveform acquiring portion 22, the waveform analyzing portion 23, and the controller 24 are shown as separate blocks in FIG. 2, but a part or all of associated functions may be realized by an arbitrary identical (common) element or the like. Further, in this embodiment, the power source portion 20, the current waveform acquiring portion 21, the voltage waveform acquiring portion 22, the waveform analyzing portion 23, and the controller 24 are provided independently of each image forming portion P. However, of these portions, at least one may be used commonly for the plurality of image forming portions P.

Incidentally, in this embodiment, a waveform shape of the AC voltage outputted from the power source portion 20 can be represented by a sine wave. In the following, a specific analyzing method in this embodiment will be described.

<Acquisition of Magnification α1 and Phase Difference ΔΘ Between Charging Current Waveform and Charging Voltage Waveform During Non-Discharge>

Figure 3:
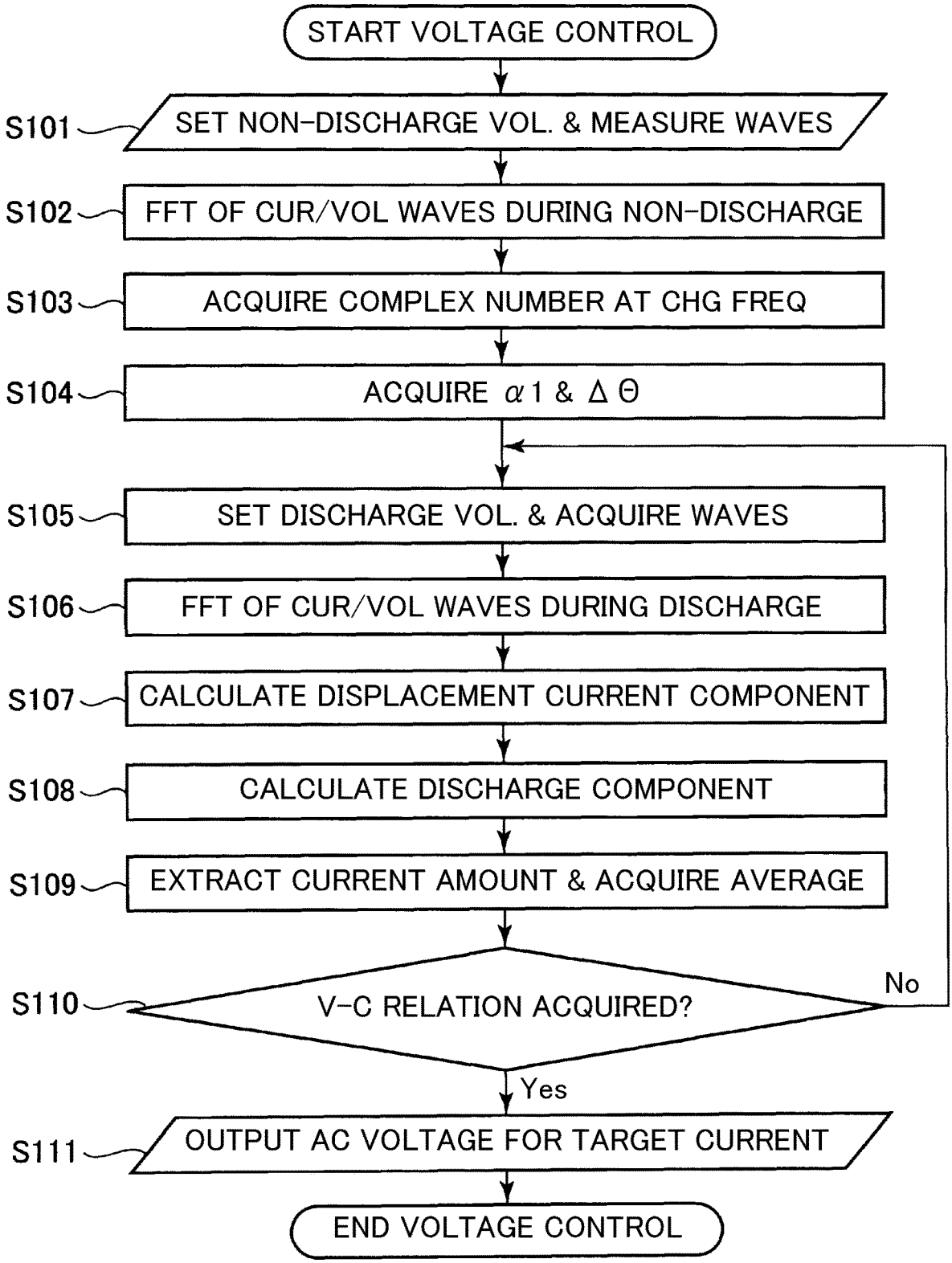
FIG. 3 is a flowchart showing a processing procedure of charging voltage control.

FIG. 3 is a flowchart showing an outline of procedure of the charging voltage control (discharge current amount control) in this embodiment. In this embodiment, every execution of the job, in the pre-rotation step before the image forming step, the charging voltage control described below for setting the charging voltage in the image forming step of the job is executed.

In S101, the charging current waveform during non-discharge and the charging voltage waveform during non-discharge are acquired by the current waveform acquiring portion 21 and the voltage waveform acquiring portion 22, respectively. This is for applying a magnification α1 and a phase difference ΔΘ between the charging current waveform during non-discharge and the charging voltage waveform during non-discharge or for acquiring information on a complex number N' (noncharge) (herein, also referred to as a "wavelength characteristic value"). The charging voltage at this time is a value which is not 0 in terms of a charging AC voltage value and is set so that there is no timing when the charging voltage does not exceed a discharge start voltage. Incidentally, setting of the charging voltage outputted by the power source portion 20 is made by the controller 24. Specifically, the charging AC voltage value during non-discharge may preferably be 0 in order to facilitate that there is no timing when the charging voltage does not exceed the discharge start voltage. Further, an AC frequency of the charging voltage ("charging frequency") during non-discharge may preferably be the same as the charging frequency during image formation (in this embodiment, these charging frequencies may preferably be the same, but may also be deviated from each other within an allowable degree of an error range. The same applies hereinafter). That is, the charging frequency during image formation is determined depending on, for example, the process speed from the viewpoints that a charging property is good and that inconveniences such as moire can be suppressed. Further, as described later, a charging frequency during discharge is required to be the same as the charging frequency during non-discharge and may preferably be the same as the charging frequency during image formation. Accordingly, the charging frequency during non-discharge may preferably be the same as the charging frequency during image formation. Incidentally, in the case where the image forming apparatus 100 is operable at a plurality of process speeds, the charging frequency during non-discharge may be changed depending on a charging frequency during image formation corresponding to the process speed for the job. Further, a charging AC voltage value (peak-to-peak voltage (Vpp) value) during non-discharge is set so that the influence of noise on the charging current waveform and the charging voltage waveform can be sufficiently suppressed and so that the electric discharge does not occur. In this embodiment, the charging voltage during non-discharge was set so that the charging frequency was 1600 V, the charging AC voltage value was 500 V, and a charging DC voltage value was 0 V. Further, a sampling interval was 16 μs (62500 Hz), and the number of sampling points was 1024 points.

Here, the acquired charging current waveform during non-discharge and the acquired charging voltage waveform during non-discharge are referred to as a "current waveform in non-discharge (I(t)-noncharge)" and a "voltage waveform in non-discharge (V(t)-noncharge)", respectively. Part (a) of FIG. 4 shows an example of an acquisition result of I(t)-noncharge and V(t)-noncharge. However, in part (a) of FIG. 4, a section from 0 ms to 2 ms is shown. Incidentally, the charging current waveform is subjected to unit conversion so that 1 μA corresponds to 1 V in consideration of subsequent processing.

Between I(t)-noncharge and V(t)-noncharge, a phase difference and a current-voltage ratio, which are based on a combined impedance of an RC electric circuit principally constituted by the photosensitive drum 1 and the charging roller 2, exist. That is, I(t)-noncharge is a displacement current (non-discharge current) acquired from V(t) noncharge and the combined impedance, and has a similar shape to V(t)-noncharge.

In S102, the waveform analyzing portion 23 subjects each of I(t)-noncharge and V(t)-noncharge to fast Fourier transformation, so that a complex number array ("FFT (I-noncharge)") for each frequency of I(t)-noncharge and a complex number array ("FFT (V-noncharge)") for each frequency of V(t)-noncharge are acquired. Part (b) of FIG. 4 shows an example of an acquisition result of frequency characteristics of FFT (I-noncharge) and FFT (V-noncharge). In part (b) of FIG. 4, the ordinate represents a signal strength value and is equal to an absolute value of the complex number of each of FFT (I-noncharge) and FFT (V-noncharge) at each of frequencies. As shown in part (b) of FIG. 4, as regards either of FFT (I-noncharge) and FFT (V-noncharge), a peak appears at an analyzing frequency in the neighborhood of 1600 Hz corresponding to the charging frequency.

In S103, the following analysis is made by the waveform analyzing portion 23 by paying attention to a complex number plane at the analyzing frequency in the neighborhood of 1600 Hz after the fast Fourier transformation. That is, a complex number Z (I-noncharge) in a frequency space in the neighborhood of the charging frequency of FFT (I-noncharge) and a complex number Z (V-noncharge) in the frequency space in the neighborhood of the charging frequency of FFT (V-noncharge) are acquired.

Here, frequency resolution Δf acquired by the fast Fourier transformation will be described. The frequency resolution Δf is determined by a sampling interval and the number of sampling points when a waveform is acquired, and a relationship therebetween is represented by the following formula.

$$\Delta f = 1/\{(\text{number of sampling points}) \times (\text{sampling interval})\}$$

In this embodiment, Δf is about 61 Hz, and therefore, the closest analyzing frequency to the charging frequency of 1600 Hz is about 1587 Hz (=Δf×26), and the second closest analyzing is about 1648 Hz. Thus, in the case where a difference from the charging frequency of 1600 Hz is different between the closest analyzing frequency and the second closest analyzing frequency, a peak at the closest analyzing frequency appears most strongly in many instances. In this case, as the analyzing frequency at which information on a wavelength characteristic value is acquired, the closest analyzing frequency to the charging frequency may preferably be selected. This is because the information on the wavelength characteristic value between the charging current waveform and the charging voltage waveform which oscillate at the charging frequency is acquired with accuracy. On the other hand, in the case where the charging frequency is in the neighborhood of an intermediate portion between the closest analyzing frequency and the second closest analyzing frequency, strong peaks appear at both the closest analyzing frequency and the second closest analyzing frequency in some instances. In this case, even when either one of the analyzing frequencies is selected, analysis can be made with little difference. From such a viewpoint, the analyzing frequency in the neighborhood of the charging frequency at which the information on the wavelength characteristic value is acquired is an analyzing frequency in a range of not less than 50% of peak strength (FIG. 4) closest to the charging frequency of the analyzing frequency of each of the charging current waveform and the charging voltage waveform after the fast Fourier transformation.

In this embodiment, (I-noncharge) is $1.037\times10^5-4.117\times10^5 i$ (i: imaginary unit) and is represented as follows when changed to polar coordinates.

$$Z(I\text{-noncharge})=\alpha(I\text{-noncharge})\times(\cos\Theta(I\text{-noncharge})+\sin\Theta(I\text{-noncharge})\ (\text{where } \alpha(I\text{-noncharge})=4.246\times10^5, \Theta(I\text{-noncharge})=284.1^\circ)$$

Further, Z(V-noncharge) is $-1.099\times10^5-0.506\times10^5 i$ and is represented as follows when changed to polar coordinates.

$$Z(V\text{-noncharge})=\alpha(V\text{-noncharge})\times(\cos\Theta(I\text{-noncharge})+\sin\Theta(V\text{-noncharge}))\ (\text{where } \alpha(V\text{-noncharge})=1.210\times10^5, \Theta(V\text{-noncharge})=204.7^\circ)$$

In S104, by the waveform analyzing portion 23, a phase difference $\Delta\Theta$ between Z(I-noncharge) and Z(V-noncharge) and a magnification $\alpha1$ of absolute values of Z(I-noncharge) and Z(V-noncharge) are acquired. In this embodiment, $\Delta\Theta$ is acquired as about 79.4° (=284.1°−204.7°), and $\alpha1$ is acquired as about 3.51 ($=4.246\times10^5/1.210\times10^5$).

Thus, the charging current waveform during non-discharge and the charging voltage waveform during non-discharge are subjected to the fast Fourier transformation, and thereafter, only the frequency space at the analyzing frequency in the neighborhood of the charging frequency is cut out, and the magnification (absolute ratio) $\alpha1$ and the phase difference $\Delta\Theta$ between the complex number of the charging current and the complex number of the charging voltage are calculated. The magnification $\alpha1$ and the phase difference $\Delta\Theta$ become characteristic values (wavelength characteristic values) of a present charging portion (measuring system).

The above-described information on the wavelength characteristic values can be acquired specifically by the following calculation. That is, Z(I-noncharge) and Z(V-noncharge) are regarded as vectors on the complex number space and are subjected to division, and thus may be calculated as a complex number Z'(noncharge) information on enlargement (reduction) and rotation at the value $\alpha1$ and the phase difference $\Delta\Theta$. Then, Z'(noncharge) can be represented by 0.644+3.45i, and this shows a combined impedance.

<Separation of Discharge Current Component from Charging Current Waveform During Discharge and Charging Voltage Waveform During Discharge>

In S105, the charging current waveform during discharge and the charging voltage waveform during discharge are acquired by the current waveform acquiring portion 21 and the voltage waveform acquiring portion 22, respectively. This is because a relationship between the charging AC voltage value and a discharge current amount during discharge (described later) is acquired. The charging voltage at this time is set so that discharge on the same side (negative discharge in this embodiment) as the charge polarity of the photosensitive drum 1 and on the opposite side (positive discharge in this embodiment) to the charge polarity of the photosensitive drum 1 occurs. Incidentally, setting of the charging voltage outputted by the power source portion 20 is made by the controller 24. Specifically, the charging frequency during discharge is required to be the same as the charging frequency during non-discharge in order to detect the discharge current amount by the charging voltage control in this embodiment. Incidentally, as described above, in the case where the image forming apparatus 100 is operable at a plurality of process speeds, the charging frequency during processing may be changed depending on the charging frequency during image formation corresponding to the process speed of the job. Further, the charging AC voltage value during discharge may preferably be set at the charging AC voltage value during image formation from the viewpoint of detection of the discharge current amount in accordance with a condition during image formation. Incidentally, the charging AC voltage value during image formation is changed on the basis of, for example, a use amount of the photosensitive drum 1 (the number of sheets for image formation, a rotation time, the number of rotations, or the like), an environment (at least one of a temperature and a humidity in at least one of an inside and an outside of the image forming apparatus), or the like.

In this case, the charging AC voltage value during discharge may preferably be changed on the basis of, for example, the above-described use amount of the photosensitive drum 1, the above-described environment, or the like so as to correspond to the charging AC voltage value during image formation. For example, the charging AC voltage value during discharge can be made large with an increasing use amount of the photosensitive drum 1. Further, for example, the charging AC voltage value during discharge can be made large with a lowering ambient humidity (or with a lowering ambient temperature). Further, a charging DC voltage value during discharge may be 0 V, but it can be said that control in accordance with the condition during image formation can be carried out by being made a value corresponding to the charging DC voltage value during image formation. Further, in the case where real-time control of the charging voltage described later is carried out, this charging DC voltage value during discharge becomes setting during image formation (see Embodiment 3). Incidentally, similarly as in the case of the above-described charging AC voltage value, the charging DC voltage value during discharge can be changed so as to correspond to the charging DC voltage value during image formation in the case where the charging DC voltage value image formation is changed. In this embodiment, as regards the charging voltage during discharge, the charging frequency was 1600 Hz which is the same as the charging frequency during non-discharge (S101), the charging AC voltage value was 1700 V corresponding to the charging AC voltage value during image formation, and the charging DC voltage value was −700 V corresponding to the charging DC voltage value during image formation. Further, the sampling interval was 16 s (62500 Hz), and the number of sampling points was 1024 points, which are the same as the acquisition condition during non-discharge (S101).

Here, as described later, in this embodiment, the charging current waveform during discharge and the charging voltage waveform during discharge are acquired for charging voltages during discharge of at least two levels. That is, the charging voltages of at least two levels in this embodiment as described above in which the discharge occurs are used.

Accordingly, the above-described values corresponding to those during image formation may only be required to be values set in advance so as to cause the discharge to occur similarly as in the case of the image formation in consideration of various conditions such as the use amount of the photosensitive drum 1 and the environment, for example. That is, for example, the setting of the charging AC voltage value during discharge may be set larger or smaller than the charging AC voltage value determined by the charging voltage control in this embodiment.

Here, the charging current waveform during discharge and the charging voltage waveform during discharge are referred to as a "charging current waveform in discharge (I(t)-charge" and a "charging voltage waveform in discharge (V(t)-charge", respectively. Part (a) of FIG. 6 shows an example of an acquisition result of I(t)-charge and V(t)-charge. However, in part (a) of FIG. 6, a section from 0 ms to 2 ms is shown. Incidentally, the charging current waveform is subjected to unit conversion so that 1 μA corresponds to 1 V in consideration of subsequent processing.

Here, I(t)-charge is considered as that a "displacement current component (non-discharge current position) (I(t)-displacement)" acquired from V(t)-charge and the combined impedance and a "discharge current component I(t)-spark" resultant from the discharge between the photosensitive drum 1 and the charging roller 2 are superimposed with each other.

In S106, by the waveform analyzing portion 23, each of I(t)-charge and V(t)-charge is subjected to the fast Fourier transformation, and a complex number array "FFT(I-charge)" for each frequency of I(t)-charge and a complex number array "FFT(V-charge)" for each frequency of V(t)-charge are acquired. Part (b) of FIG. 6 shows an example of an acquisition result of a frequency characteristic of FFT(I-charge) and FFT(V-charge). Incidentally, in part (b) of FIG. 6, the ordinate represents a signal strength value for each of frequencies, and these values are equal to absolute values of complex numbers at the respective frequencies of FFT(I-charge) and FFT(V-charge). As shown in part (b) of FIG. 6, as regards either one of FFT(I-charge) and FFT(V-charge), a peak appears at an analyzing frequency in the neighborhood of 1600 Hz corresponding to the charging frequency. Further, as regards FFT(I-charge), peaks also appear at frequencies which are odd-number times (3 times and 5 times) the charging frequency.

Then, by the waveform analyzing portion 23, the following analysis is made by paying attention to the complex number plane at the analyzing frequency in the neighborhood of 1600 Hz after the fast Fourier transformation. That is, shown in FIG. 7, a complex number Z(I-charge) in a frequency space in the neighborhood of a charging frequency of FFT(I-charge) and a complex number Z(V-charge) in a frequency space in the neighborhood of a charging frequency of FFT(V-charge) are acquired.

In this embodiment, Z(I-charge) is $0.81719\times10^6-1.229\times10^6 i$, and is represented as follows when changed to polar coordinates.

$$Z(I\text{-charge})=\alpha(I\text{-charge})\times(\cos\Theta(I\text{-charge})+\sin\Theta(I\text{-charge})) \text{ (where } \alpha(I\text{-charge})=1.476\times10^6, \Theta(I\text{-charge})=56.4°)$$

Further, Z(V-charge) is $0.393\times10^6-0.120\times10^6 i$ and is represented as follows when changed to polar coordinates.

$$Z(V\text{-noncharge})=\alpha-(V\text{-charge})\times(\cos\Theta(I\text{-charge})+\sin\Theta(V\text{-charge})) \text{ (where } \alpha(V\text{-charge})=0.411\times10^6, \Theta(I\text{-charge})=343.0°)$$

In S107, by the waveform analyzing portion 23, a "complex number (Z(I-displacement) of non-discharge current component" is acquired. That is, Z(I-displacement) can be acquired by rotating and enlarging Z(V-charge) with use of the phase difference ΔΘ (about 79.4°) and the absolute value magnification α1 (about 3.51) which are acquired from Z(I-noncharge) and Z(V-noncharge) in S104.

In S108, by the waveform analyzing portion 23, a "complex number (Z(I-spark)) of discharge current component" is acquired. That is, a difference between Z(I-charge) and Z(I-displacement) is Z(I-spark). For that reason, Z(I-spark) can be calculated by acquiring this difference.

The above-described Z(I-spark) can be specifically acquired by the following calculation. That is, all the above-described complex numbers are regarded as vectors, so that Z(I-displacement) can also be acquired by multiplication between Z(V-charge) and Z'(noncharge). That is, I(t)-charge is superimposition between the non-discharge current component (I-displacement) and the discharge current component (I-spark) and is represented as follows in a complex number space in the neighborhood of the charging frequency in the frequency space.

$$Z(I\text{-charge})=Z(I\text{-displacement})+Z(I\text{-spark})$$

Here, the following relationship holds.

$$Z(I\text{-displacement})=Z(I\text{-charge})\times Z'(\text{noncharge}), \text{ or}$$

$$Z(I\text{-displacement})=\alpha1\times\alpha(I\text{-charge})\times(\cos\Theta(I\text{-charge})+\Delta\Theta+\sin\Theta(I\text{-charge})+\Delta\Theta).$$

For that reason, the following deformation can be made. Z(I-spark)=Z(V-charge)−Z(V-charge)×Z'(noncharge). That is, when Z(V-charge), Z(I-charge), and Z'(noncharge) are acquired, only the discharge current component of the charging control can be extracted.

In this embodiment, in S108, the waveform analyzing portion 23 acquires a waveform (discharge current waveform) obtained by extracting only the discharge current component from the charging current. For that purpose, the above-described processing (processing for acquiring Z(I-spark) with use of the wavelength characteristic value (magnification α1 and phase difference ΔΘ)) is performed for all the frequencies (all the analyzing frequencies in the frequency characteristic acquired by the fast Fourier transformation) after the fast Fourier transformation. Specifically, FFT(V-charge)×Z'(noncharge) is subtracted from FFT(I-charge). A resultant complex number array by this corresponds to a complex number array (FFT(I-spark)) of the discharge current component subjected to the fast Fourier transformation. FFT(I-charge) is a complex number of a current waveform in discharge, FFT(V-charge)×Z'(noncharge) is a complex number of a displacement current waveform which is a displacement current component in the current waveform in discharge, and FFT(I-spark) is a complex number of the discharge current waveform which is a discharge current component in the current waveform in discharge.

Thus, by using the wavelength characteristic value (magnification al and phase difference ΔΘ, or Z'(noncharge)) which is a characteristic value of a present charging portion (measuring system), a displacement current (non-discharge current) in the case where there is no discharge is predicted. Then, the displacement current (non-discharge current) predicted from the measured charging current is subjected to subtraction with vector, so that the discharge current is extracted. That is, the discharge current can be extracted as a complex number in a frequency region. The thus-extracted complex number of the discharge current is capable of being converted into a waveform in a real number region.

In S109, by the waveform analyzing portion 23, a discharge current waveform in a real space is acquired by subjecting the above-described FFT(I-spark) to the fast Fourier transformation.

However, in this embodiment, although the DC voltage component is superimposed on V(t)-charge, the DC voltage component is not superimposed on I(f)-charge. For that reason, when the above-described discharge is performed as it is, the DC voltage component of I-spark is erroneously calculated, and therefore, there is a need to remove the DC voltage component of V(t)-charge in advance before the above-described processing is performed. Specifically, an average of values of V(t)-charge is acquired, and then a value obtained by subtracting the average from V(t)-charge may be subjected to the fast Fourier transformation. Or, a first value of FFT(V-charge) may be made 0 (i.e., the first value in the frequency space is the sum (integrated value) of values of a real space waveform, and therefore the first value of 0 corresponds to that the waveform is corrected so that the average of the values of the real space waveform becomes 0).

Further, when data of, for example, N points ("data before conversion") is subjected to the fast Fourier transformation, as shown in FIG. 7, complex numbers at N points in the frequency space are acquired, but a first value thereof indicates an average of the data before conversion and is a real number. Further, complex numbers from a second value to N/2-th value are complex conjugates (numbers) replaced in order from ((N/2)+2)-th value to N-th value. Further, ((N/2)+2)-th value has strength of a waveform of which frequency is N/2 and becomes a real number since there is no phase at this time. In view of the above, when FFT(I-spark) is acquired, as regards values from k=1(st) to k=512-th, as described above, it is only required that FFT(V-charge)(k) is multiplied by Z'(noncharge), and as regards values from k=514-th to k=1024-th, it is only required that FFT(V-charge)(k) is multiplied by complex conjugate Z'(noncharge). Further, a value of k=513-th is a waveform of N/2 in frequency, and therefore, the value has no phase information originally and becomes a real number. Therefore, as regards FFT(V-charge) (513), it is only required that FFT(V-charge) (513) is multiplied by as absolute value of Z'(noncharge).

In S109, the waveform analyzing portion 23 performs conversion from the frequency space into a real space by subjecting the above-acquired FFT(I-spark) to the fast Fourier transformation, and thus calculates a discharge current component (I(t)-spark), i.e., a discharge current waveform. Parts (a) and (b) of FIG. 9 show an example of the thus-calculated I(t)-spark. In part (a) of FIG. 9, all the regions subjected to the processing are shown, but distortion is observed at opposite ends of data, and therefore, for example, as shown in part (b) of FIG. 9, processing may preferably be performed by selecting only ¼ region from a center of the data on each of opposite sides with respect to the center of the data and by disregarding other regions in the neighborhood of the opposite ends of the data.

Next, in S109, the waveform analyzing portion 23 calculates, from I-spark, a positive discharge component achieving a smoothing effect of the surface potential of the photosensitive drum 1. Discharge occurring when the charging voltage is on a positive side of the charging DC voltage value is positive discharge. For that reason, as shown in part (a) of FIG. 10, a region in which V(t)-charge is on the positive side of the charging DC voltage value is referred to as a positive charging region, and a region in which V(t)-charge is on a negative side of the charging DC voltage value is referred to as a negative charging region. This is because when the polarity of V(t)-charge is negative, with respect to the photosensitive drum 1 negatively charged in the negative charging region, discharge of the opposite polarity occurs in the positive charging region. Then, in S109, as shown in part (b) of FIG. 10, the waveform analyzing portion 23 extracts only the data in the positive discharge region from I(t)-spark and then calculates a positive discharge current amount by acquiring an average of the extracted data. In this embodiment, in the case where the charging AC voltage value is 1700 V, an average signal value is acquired as 45.8, whereby it was confirmed that the positive discharge current amount is 45.8 μA.

<Acquisition of Target Charging AC Voltage Value from Analysis Result of Plurality of Charging AC Voltage Values)

In S110, setting of the charging voltage outputted from the power source portion 20 is changed by the controller 24, and processes from S105 to S109 are repeated, so that the positive discharge current amount in each of settings of a plurality of charging voltages is calculated. The setting of the charging voltage at this time is as described above. That is, the charging AC voltage value is changed within a range in which the positive discharge occurs, and thus the positive discharge current amount is calculated, so that a relationship between the charging AC voltage value and the positive discharge current amount is acquired. For example, the charging AC voltage value is decreased from the voltage 1700 V by 100 V (the charging DC voltage value and the charging frequency are not changed), and then the positive discharge current amount is calculated by the processes from S105 to S109. FIG. 11 and Table 1 below show an example of a calculation result of the positive discharge current amount when the charging AC voltage value is changed from 1400 V to 1700 V with an increment of 100 V.

TABLE 1

| CAVV*1 [V] | 1400 | 1500 | 1600 | 1700 |
|---|---|---|---|---|
| PDCA*2 [μA] | 0 | 10.0 | 29.0 | 45.8 |

*1"CAVV" is the charging AC voltage value.
*2"PDCA" is the positive discharge current amount.

A shown in FIG. 11 and the Table 1, it is understood that the positive discharge current amount increases with an increasing charging AC voltage value.

In S111, by the waveform analyzing portion 23, the charging AC voltage value during image formation is determined on the basis of the relationship between the charging AC voltage value and the positive discharge current amount which are acquired in S110. That is, in the case where the charging AC voltage value is low and the photosensitive drum surface potential-smoothing effect by the positive discharge is not sufficient, a white spot image which is called "sandy image ("SAND")" and which is caused due to abnormal discharge occurs. However, by study by the present inventors, in the constitution of this embodiment, it is found that the "sandy image" does not occur in the case where the positive discharge current amount is 25 μA or more. As shown in FIG. 11, for example, from the relationship between the charging AC voltage value and the positive discharge current amount when the charging AC voltage value is 1500 V and 1600 V, it is possible to calculate that the positive discharge current amount becomes 25 μA or more when the charging AC voltage value is 1580 V or more. Incidentally, for example, this is true for the case where the charging AC voltage value at which the positive discharge current amount becomes 25 μA or more is calculated from the relationship of the charging AC voltage value and the positive discharge current amount when the charging AC voltage value is 1600 V and 1700, and a target charging AC voltage value may be acquired by interpolation or extrapolation. Thus, in S111, the waveform analyzing portion 23 acquires the charging AC voltage value at which the positive discharge current amount becomes a predetermined value (target value) set in advance, on the basis of the relationship between the charging AC voltage value and the positive discharge current amount acquired in S110. This relationship between the charging AC voltage value and the positive discharge current amount can be acquired as a linear expression indicating a relationship between charging AC voltage values of at least two levels in the discharge region and positive discharge current amounts calculated at the respective levels. Further, a predetermined value of the positive discharge current amount can be acquired in advance so that the positive discharge current amount is decreased to the extent possible within a range in which the occurrence of the "sandy image" can be sufficiently suppressed. In the constitution of this embodiment, in the case where the relationship as shown in FIG. 11 is acquired, the charging AC voltage value for image formation is determined as 1580 V at which the positive discharge current amount becomes 25 μA. Then, the waveform analyzing portion 23 sends (outputs), to the controller 24, an instruction such that the charging AC voltage value for image formation is set at the above-determined value. The controller 24 causes the storing portion to store information on this charging AC voltage value and uses the information as setting of the charging voltage for subsequent image formation.

Incidentally, the charging DC voltage value for image formation is separately set at a predetermined value set in advance or a value depending on, for example, the use amount of the photosensitive drum 1, the environment, or the like.

Further, in FIG. 11 and the Table 1, for explanation, values relating to the charging AC voltage values of four levels are shown, but as described above, in this embodiment, the relationship between the charging AC voltage value and the discharge current amount may only be required to be acquired for the charging AC voltage values of at least two levels in the discharge region. Further, the plurality of charging AC voltage values may be changed to successively descending values such as 1700 V and 1600 V or to successively ascending values such as 1600 V and 1700 V.

Further, the charging AC voltage value for image formation may be determined so that the discharge current amount falls under a range of a predetermined first threshold or more and a predetermined second threshold (>predetermined first threshold) or less.

Here, in this embodiment, the above-described charging voltage control is carried out in the pre-rotation step of the job, so that charging processing in which the occurrence of the sandy image or the like is suppressed during image formation by an appropriate charging voltage can be performed (part (a) of FIG. 13). Incidentally, "during image formation" for the charging portion refers to a time (period) when an image forming region in which the image (electrostatic latent image, toner image) is formed on the photosensitive drum 1 passes through a charging portion along a rotational direction of the photosensitive drum 1 (i.e., when the image forming region opposes the charging roller 2). Further, "during non-image formation" specifically refers to a time (period) when a non-image forming region in which the image is not formed on the photosensitive drum 1 passes through the charging portion along the rotational direction of the photosensitive drum 1 (i.e., when the non-image forming portion opposes the charging roller 2). Further, the charging portion specifically refers to a position where the charging processing is performed by the charging roller 2, with respect to the rotational direction of the photosensitive drum 1. In this embodiment, the surface of the photosensitive drum 1 is electrically charged by the charging roller 2 by electric discharge generated at least at one of gaps between the charging roller 2 and the photosensitive drum 1 formed on an upstream side and a downstream side of the charging nip with respect to a surface movement direction of the photosensitive drum 1. However, for simplification, the charging nip may be regarded as the charging portion. Incidentally, the charging voltage control is not limited to one executed in the pre-rotation step in each job, but can be executed in the pre-rotation step in the job at a predetermined frequency such as the case where images are formed on a predetermined number of sheets, for example. Further, the charging voltage control may also be carried out in another non-image formation time (period) such as the pre-multi-rotation step or the like.

Further, for example, during continuous image formation or the like, information on the wavelength characteristic value (al and AO or Z'(noncharge)) acquired from the waveform during non-discharge is stored, and then acquisition and analysis of the waveform during discharge may be carried out in a sheet interval step. Specifically, as shown in part (b) of FIG. 13, the waveform analyzing portion 23 performs acquisition of the waveform during non-discharge, acquisition of information on the wavelength characteristic value, and storage of the acquired information on the wavelength characteristic value in the pre-rotation step in a job of the continuous image formation. Further, the waveform analyzing portion 23 performs acquisition of the waveform during discharge, acquisition of the discharge current amount with use of the above-stored information on the wavelength characteristic value, and determination of the charging voltage in the sheet interval step in the job of the continuous image formation. Then, in a subsequent image forming step, the charging processing is performed at setting of the above-determined charging voltage. For example, the charging voltage in the image forming step for forming the image(s) on a single or plurality of recording materials S including a first sheet in the job of the continuous image formation (typically, a first recording material S) is determined as a predetermined value set in advance. Then, from a charging voltage in the image forming step for forming the image on the recording material S as an arbitrary N-th sheet which is a second sheet or later (typically a second recording material S or later), the charging voltage can be set as the charging voltage determined on the basis of the discharge current amount acquired in the sheet interval step. Thus, in the pre-rotation step, the acquisition of the waveform during discharge or the like is not performed, so that a first print out time (FPOT: time from input of an image forming instruction to output of the first recording material on which the image is formed) can be shortened. Incidentally, in order to set the charging voltage in the image forming step for forming the image on the first recording material S in the job of the continuous image formation, the acquisition of the waveform during discharge or the like can also be performed in the pre-rotation step. Further, the information acquired in the pre-rotation step may also be acquired during another non-image formation.

4. Effect

Thus, the image forming apparatus 100 of this embodiment includes the image bearing member 1, the charging member 2 disposed in contact with or in proximity to the surface-to-be-charged of the image bearing member 1, the power source portion 20 for applying, to the charging member 2, the charging voltage which is the oscillating voltage of the predetermined frequency in the superimposed form including the DC voltage and the AC voltage, the waveform acquiring portions 21 and 22 for acquiring the current waveform which is the waveform of the current flowing through the charging member 2 when the power source portion 20 applies the voltage to the charging member 2 and the voltage waveform which is the waveform of the voltage applied to the charging member 2 by the power source portion 20, the processing portion 23 for performing the operation processing on the basis of the current waveform and the voltage waveform acquired by the waveform acquiring portions 21 and 22, and the controller 24 for controlling the power source portion 20. Further, the processing portion 23 executes the following pieces of processing consisting of: processing for calculating a first complex number at an analyzing frequency in the neighborhood of the above-described charging frequency of the above-described current waveform in non-discharge and a second complex number at the analyzing frequency of the voltage waveform in non-discharge by executing first acquiring control for acquiring the current waveform in non-discharge and the voltage waveform in non-discharge by the waveform acquiring portions 21 and 22 under application, to the charging member 2, of the oscillating voltage in which the DC voltage and the AC voltage are set so as not to exceed a discharge start voltage and then by subjecting each of the current waveform in non-discharge and the voltage waveform in non-discharge to the fast Fourier transformation, processing for calculating a third complex number at the above-described analyzing frequency of the above-described current waveform in discharge and a fourth complex number at the analyzing frequency of the voltage waveform in discharge by executing second acquiring control for acquiring the current waveform in discharge and the voltage waveform in discharge by the waveform acquiring portions 21 and 22 under application, to the charging member 2, of the oscillating voltage in which the DC voltage and the AC voltage are set so as to exceed a discharge start voltage and then by subjecting each of the current waveform in discharge and the voltage waveform in discharge to the fast Fourier transformation, processing for calculating a complex number of a discharge current waveform which is a discharge current component in the above-described current waveform in discharge on the basis of the first complex number, the second complex number, the third complex number, and the fourth complex number and for determining a value of an AC voltage of the charging voltage for image formation on the basis of a result of the calculation. Further, the controller 24 controls the power source portion 20 so as to apply, to the charging member 2, the charging voltage including the AC voltage component of the value determined by the processing portion 23. In this embodiment, the processing portion 23 calculates a complex number of a displacement current waveform which is a displacement current component in the above-described current waveform in discharge on the basis of the phase difference and the magnification (wavelength characteristic value) in absolute value between the first complex number and the second complex number and on the basis of the fourth complex number, and calculates a complex number of the above-described current waveform in discharge by calculating a difference between the third complex number and the complex number of the displacement current waveform. Further, in this embodiment, the processing portion 23 calculates a discharge current waveform by subjecting a complex number array to the fast Fourier transformation, acquired by calculating the complex number of the current waveform in discharge for all the frequencies after the fast Fourier transformation. Further, in this embodiment, the processing portion 23 acquires a discharge current on the above-described predetermined polarity side, of the above-described discharge current waveform, which is a discharge current in the case where the voltage value of the voltage waveform in discharge is larger in opposite polarity side to the charge polarity of the above-described surface-to-be-charged than a value of the DC voltage of the oscillating voltage applied to the charging member 2 in the above-described second acquiring control. Further, in this embodiment, the processing portion 23 sets a value of the AC voltage of the charging voltage for image formation so that the value of the discharge current on the predetermined polarity side becomes a predetermined value.

Further, in this embodiment, the processing portion 23 executes the first acquiring control and the second acquiring control in a preparatory operation before the image forming step of the job which is a series of image output operations for forming the image(s) on a single or plurality of recording materials by a single start instruction. However, the processing portion 23 is also capable of executing the first acquiring control in the preparatory operation before the above-described image forming step of the job and is also capable of executing the second acquiring control in the recording material interval step between the image forming step and a subsequent image forming step of the job. In this case, the processing portion 23 is capable of not executing the second acquiring control in the preparatory operation. Further, in this embodiment, in the second acquiring control, the processing portion 23 acquires each of the above-described current waveform in discharge and the voltage waveform in discharge by applying, to the charging member 2, oscillating voltages of at least two levels different in AC voltage value. Further, in this embodiment, the processing portion 23 makes a value of the DC voltage of the oscillating voltage applied to the charging member 2 substantially 0 V. Further, in this embodiment, the processing portion 23 makes a value of the DC voltage of the oscillating voltage applied to the charging member 2 in the second acquiring control a value of the same polarity as the charge polarity of the surface-to-be-charged. Further, in this embodiment, before or after the fast Fourier transformation of the above-described voltage waveform in discharge, the processing portion 23 performs processing of removing, from the voltage waveform in discharge, the DC voltage component of the oscillating voltage applied to the charging member 2 in the second acquiring control.

As described above, according to the charging voltage control in this embodiment, the charging current waveforms during non-discharge and during discharge and the charging voltage waveforms during non-discharge and during discharge are acquired, and a non-discharge current component (displacement current component) estimated by the Fourier transformation is subtracted from the charging current during discharge, and thus the discharge current component is calculated. By this, different from the conventional method using the proportional expression between the voltage of the AC component and the current in the non-discharge region, it is possible to prevent that a detection error of the AC amount in the non-discharge region due to the influence of the noise or the like is amplified in the proportion expression and thus the discharge current amount cannot be extracted with accuracy. Accordingly, according to the charging voltage control in this embodiment, the discharge current amount is accurately detected without being influenced by the amplification of the detection error of the AC amount in the non-discharge region which can occur in the case of using the approximate straight line between the voltage of the AC component and the current in the non-discharge region, so that an appropriate charging voltage can be set.

Further, in the charging voltage control in this embodiment, each of the charging current waveform during non-region and the charging voltage waveform during non-discharge is acquired by a charging AC voltage value of one level, and each of the charging current waveform during discharge and the charging voltage waveform during discharge is acquired by charging AC voltage values of two levels. Thus, according to the charging voltage control in this embodiment, measurement of the charging current waveforms and the charging voltage waveforms is made at charging AC voltage values of three levels in total. Accordingly, an appropriate charging voltage can be set in a relatively short time.

Embodiment 2

Next, another embodiment of the present invention will be described. Basic constitutions and operations of an image forming apparatus in this embodiment are the same as those of the image forming apparatus in the embodiment 1. Accordingly, in the image forming apparatus in this embodiment, elements having the same or corresponding functions and constitutions as those in the image forming apparatus in the embodiment 1 are represented by the same reference numerals or symbols as those in the embodiment 1 and will be omitted from detailed description.

In the embodiment 1, when Z(I-spark) is acquired, the processing is performed by using the following relationship.

$$Z(I\text{-spark})=Z(I\text{-charge})-Z(V\text{-charge})\times Z'(\text{noncharge})$$

This is based on the premise that the following relationship is satisfied.

$$Z(I\text{-displacement})=Z(V\text{-charge})\times Z'(\text{noncharge})$$

In the case where each of V(t)-noncharge and V(t)-charge is a sine wave, the above relationship is satisfied. However, for example, if each of V(t)-noncharge and V(t)-charge is a rectangular wave or a saw-tooth-wave, which are different from the sine wave, the displacement current component (I(t)-displacement) is different in waveform from V(t)-noncharge and V(t)-charge, and therefore Z(I-spark) cannot be calculated based on the premise that the above-described relationship is satisfied. Then, the discharge current component (I(t)-spark) cannot be calculated.

In this embodiment, means capable of calculating the discharge current component and further the positive discharge current amount even in the case where the charging voltage waveform is other than the sine wave will be described. Specifically, in the embodiment 1, I(t)-displacement was calculated from V(t)-charge, but in this embodiment, I(t)-displacement is calculated from I(t)-noncharge.

For explanation, a waveform to be analyzed is the same as the waveform to be analyzed in the embodiment 1. FIG. 12 shows complex numbers (Z(I-noncharge), Z(I-charge), Z(V-noncharge), Z(V-charge), Z(I-displacement)) at each of analyzing frequencies in the neighborhood of the charging frequency, which are acquired by subjecting each waveform to the fast Fourier transformation. As shown in FIG. 12, the respective values of Θ are as follows.

$$\Theta(V\text{-charge})=343.0°$$

$$\Theta(V\text{-noncharge})=204.7°$$

$$\Theta(I\text{-noncharge})=284.10$$

When conversion from Z(I-displacement) is made, Θ(I-displacement) is acquired as follows.

$$\Theta(I\text{-displacement})=\Theta(I\text{-noncharge})+\Theta(V\text{-charge})-\Theta(V\text{-noncharge})=284.1°+343.0°-204.7°=422.4°(62.4°)$$

That is, Z(I-displacement) is predicted as being at 422.4°. For that reason, Z(I-noncharge) is 284.1°, so that Z(I-noncharge) may only be required to be rotated by 138.3° (=422.4°−284.1°). Further, values of magnification are as follows.

$$\alpha(I\text{-noncharge})=4.246\times10^5$$

$$\alpha(V\text{-noncharge})=1.210\times10^5$$

$$\alpha(V\text{-charge})=0.411\times10^5$$

Therefore, when the following relationship holds, $$\alpha2=\alpha(V\text{-charge})/\alpha(V\text{-noncharge})=3.397,$$

$$\alpha(I\text{-displacement})=\alpha(I\text{-noncharge})\times\alpha2=1.442\times10^6$$

That is, an absolute value of Z(I-displacement) is acquired by enlarging an absolute value of Z(I-noncharge) by α2(3.397) times.

The above-acquired rotation and enlargement are performed over all the frequency regions of I(t)-noncharge after the fast Fourier transformation, so that a "complex number (Z(I-displacement)) of non-discharge current component" can be acquired. Further, a difference between Z(I-charge) and Z(I-displacement) is a "complex number (Z(I-spark)) of non-discharge current component". For that reason, Z(I-spark) can be calculated by acquiring this difference.

The above calculation can also be acquired similarly as described in the embodiment 1 by regarding all the complex numbers as vectors and by performing multiplication of the complex numbers.

Further, subsequent processing such as separation of the positive discharge current amount is similar to the processing in the embodiment 1, and therefore, redundant explanation will be omitted.

Thus, in this embodiment, the processing portion 23 calculates the complex number of the displacement current waveform which is the displacement current component in the current waveform in discharge on the basis of the phase difference and the magnification (wavelength characteristic value) is absolute value between the second complex number at the analyzing frequency in the neighborhood of the charging frequency of the voltage waveform in non-discharge and the fourth complex number at the analyzing frequency of the voltage waveform in discharge and on the basis of the first complex number at the analyzing frequency in the neighborhood of the charging frequency of the current waveform in non-discharge, and calculates the complex number of the discharge current waveform by calculating the difference between the third complex number at the analyzing frequency of the current waveform in discharge and the complex number of the displacement current waveform.

As described above, according to the charging voltage control in this embodiment, even in the case where the charging voltage waveform is a wave other than the sine wave, an effect similar to the effect of the embodiment 1 can be obtained.

Embodiment 3

Next, another embodiment of the present invention will be described. Basic constitutions and operations of an image forming apparatus in this embodiment are the same as those of the image forming apparatus in the embodiment 1. Accordingly, in the image forming apparatus in this embodiment, elements having the same or corresponding functions and constitutions as those in the image forming apparatus in the embodiment 1 are represented by the same reference numerals or symbols as those in the embodiment 1 and will be omitted from detailed description.

As a feature of the analyzing method of the charging voltage control in accordance with the present invention, even in a state in which the charging DC voltage value is applied, the discharge current amount can be calculated in some instances.

That is, according to the analyzing method of the charging voltage control in accordance with the present invention, for example, even during image formation, the discharge current amount can be calculated, and further on the basis of a result thereof, the charging AC voltage value can be subjected to feed-back control sequentially (in real time) so as to provide an appropriate discharge amount. Thus, according to the analyzing method of the charging voltage control in accordance with the present invention, real-time control of the charging voltage can be realized.

Incidentally, an analyzing method of the charging voltage control (discharge current amount control) in this embodiment is similar to the analyzing methods in the embodiments 1 and 2, and therefore, redundant explanation will be omitted.

Specifically, the waveform analyzing portion 23 performs, as shown in part (c) of FIG. 13, the acquisition of the waveform during non-discharge, the acquisition of the information on the wavelength characteristic values ($\alpha 1$ and AO or Z'(noncharge) or the like), and the storage of the acquired information on the wavelength characteristic values. Further, the image forming step for forming the image on the first recording material S in the job is started by using the charging voltage at a predetermined voltage set in advance. Then, during the image forming step, the waveform analyzing portion 23 sequentially performs the acquisition of the waveform during discharge, the acquisition of the discharge current amount with use of the above-stored information on the wavelength characteristic values, and the determination of the charging voltage. By this, for example, the charging voltage can be controlled in real time from an intermediate point of time in the image forming step for forming the image on the first recording material S. At this time, the charging AC voltage value can be made small in the case where a discharge current amount acquired in real time at a present charging AC voltage value is larger than a target value, and can be made large in the case where the discharge current amount is smaller than the target value. The charging AC voltage value may be changed every predetermined change range or may also be changed correspondingly to a change amount calculated at the time of each change so that the discharge current amount becomes the target value. Thus, the real-time control of the charging voltage is carried out, so that the charging processing can be performed substantially always at an appropriate discharge current amount. Further, in the pre-rotation step, the acquisition of the waveform during discharge or the like is not performed, so that the FPOT can be shortened.

Here, the real-time control of the charging voltage is not limited to control in which the charging voltage can be controlled in real time from the point of time of the image forming step for forming the image on the first recording material S. For example, such real-time control may be enabled from a sheet interval between the image forming step for forming the image on the first recording material S and an image forming step for forming the image on the second recording material S in a continuous image forming job or from an image forming step for forming the image on an arbitrary number-th recording material S after the second recording material S. Further, an interval in which the discharge current amount is acquired can be arbitrarily set. In the real-time control, for example, in addition to the control such that the charging voltage is controlled by substantially always acquiring the discharge current amount, control such that the charging voltage is controlled by acquiring the discharge current amount with a predetermined transfer such as every image forming step for forming the image(s) on a single recording material S or a plurality of recording materials S is included. Incidentally, the information acquired in the pre-rotation step may also be acquired during another non-image formation such as the pre-multi-rotation step.

Further, for example, in the continuous image forming job, at a predetermined frequency such as every image forming step for forming the images on the plurality of recording materials S, the acquisition of the waveform during the non-discharge, the acquisition of the information on the wavelength characteristic values, and the storage (updating) of the acquired information on the wavelength characteristic values may be performed during the sheet interval.

Further, also, in the case where the real-time control of the charging voltage is carried out, for example, in order to set the charging voltage in the image forming step for forming the image on the first recording material S in the continuous image forming job, the acquisition of the waveform during discharge and the like can be performed even in the pre-rotation step.

Thus, in this embodiment, the processing portion 23 executes the first acquiring control for acquiring the current waveform information and the voltage waveform in non-discharge in the preparatory operation before the image forming step in the job which is series of image output operations for outputting the image(s) on the single recording material S or the plurality of recording materials S by a single start instruction, and executes the second acquiring control for acquiring the current waveform in discharge and the voltage waveform in discharge in the image forming step. The controller 24 real-time controls the charging voltage applied to the charging member 2 in the image forming step by using a result of the second acquiring control executed in the image forming step. In this case, the processing portion 23 is capable of not executing the second acquiring control in the above-described preparatory operation.

As described above, according to the charging voltage control in this embodiment, the charging processing can be substantially always performed at an appropriate discharge current amount by carrying out the real-time control of the charging voltage.

Other Embodiments

The present invention was described based on the specific embodiments mentioned above, but is not limited to the above-mentioned embodiments.

In the above-described embodiments, the charging member was contacted to the surface of the photosensitive drum, which was the surface-to-be-charged of a member-to-be-charged, but is not necessarily required to be contacted to the surface-to-be-charged of the member-to-be-charged. When a dischargeable region based on Paschen's law is provided between the charging member and the member-to-be-charged, the charging member may also be disposed in non-contact with the member-to-be-charged with a spacing (gap) of several 10 μm, for example.

Further, in the above-described embodiments, the charging member was the roller-shaped member, but is not limited to the roller-shaped member. The charging member may also be a member, which is stretched by a plurality of stretching rollers and which is formed in an endless belt shape, a blade shape, or a sheet shape. The photosensitive member as the member-to-be-charged is not limited to the drum-shaped member (photosensitive drum), but may also be an endless belt-shaped photosensitive member (photosensitive member belt). Further, the image bearing member as the member-to-be-charged is not limited to the photosensitive member. When the image forming apparatus is of an electrostatic recording type, the image bearing member is an electrostatic recording dielectric member formed in a drum shape or in an endless belt shape.

Further, the image forming apparatus is not limited to the color image forming apparatus including the plurality of image forming portions, but may also be a monochromatic image forming apparatus including a single image forming portion for forming a monochromatic (single-color) image.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-093313 filed on Jun. 2, 2021, which is hereby incorporated by reference herein in its entirety.

What is claimed is:

1. An image forming apparatus comprising:

an image bearing member;

a charging member provided in contact with or in a neighborhood of a surface-to-be-charged of said image bearing member;

a power source portion configured to apply, to said charging member during image formation, a charging voltage which is a superimposed oscillating voltage including a DC voltage and an AC voltage and having a predetermined charging frequency;

a waveform acquiring portion configured to acquire a current waveform of a current flowing through said charging member when said power source portion applies the charging voltage to said charging member and a voltage waveform of the charging voltage applied to said charging member by said power source portion;

a processing portion configured to perform operation processing on the basis of the current waveform and the voltage waveform which are acquired by said waveform acquiring portion; and a controller configured to control said power source portion, wherein said processing portion executes:

processing for calculating a first complex number at an analyzing frequency in a neighborhood of the charging frequency of a current waveform in non-discharge and a second complex number at the analyzing frequency of a voltage waveform in non-discharge by executing first acquiring control for acquiring the current waveform in non-discharge and the voltage waveform in non-discharge under application of the oscillating voltage in which the DC voltage and the AC voltage are set so as not to exceed a discharge start voltage and by subjecting each of the current waveform in non-discharge and the voltage waveform in non-discharge to fast Fourier transformation, processing for calculating a third complex number at the analyzing frequency of a current waveform in discharge and a fourth complex number at the analyzing frequency of a voltage waveform in discharge by executing second acquiring control for acquiring the current waveform in discharge an the voltage waveform in discharge under application of the oscillating voltage in which the DC voltage and the AC voltage are set so as to exceed the discharge start voltage and by subjecting each of the current waveform in discharge and the voltage waveform in discharge to the fast Fourier transformation, and processing for calculating a complex number of a discharge current waveform which is a discharge current component of the current waveform in discharge on the basis of the first complex number, the second complex number, the third complex number, and the fourth complex number, and then for determining a value of the AC voltage of the charging voltage during the image formation on the basis of a calculation result of the complex number of the discharge current waveform, and wherein said controller controls said power supply portion so as to apply, to said charging member, the charging voltage including an AC voltage component with the value determined by said processing portion.

2. An image forming apparatus according to claim 1, wherein said processing portion calculates the complex number of the discharge current waveform by calculating a complex number of a displacement current waveform which is a displacement current component of the current waveform in discharge on the basis of a phase difference and a magnification in absolute value between the first complex number and the second complex number and on the basis of the fourth complex number and then by calculating a difference between the third complex number and the complex number of the displacement current waveform.

3. An image forming apparatus according to claim 1, wherein said processing portion calculates the complex number of the discharge current waveform by calculating a complex number of a displacement current waveform which is a displacement current component of the current waveform in discharge on the basis of a phase difference and a magnification in absolute value between the second complex number and the fourth complex number and on the basis of the first complex number and then by calculating a difference between the third complex number and the complex number of the displacement current waveform.

4. An image forming apparatus according to claim 1, wherein said processing portion calculates the discharge current waveform by subjecting, to the fast Fourier transformation, a complex number array acquired by calculating the complex number of the discharge current waveform for all frequencies after the fast Fourier transformation.

5. An image forming apparatus according to claim 4, wherein said processing portion acquires a discharge current on a predetermined polarity side, of the discharge current waveform, which is a discharge current in a case that the voltage waveform in discharge is larger, on a polarity side opposite to a charge polarity of the surface-to-be-charged, than a value of the DC voltage of the oscillating voltage applied to said charging member in the second acquiring control.

6. An image forming apparatus according to claim 5, wherein said processing portion sets a value of the AC voltage of the charging voltage during the image formation so that a value of the discharge current on the predetermined polarity side is a predetermined value.

7. An image forming apparatus according to claim 1, wherein said processing portion executes the first acquiring control and the second acquiring control in a preparatory operation before an image forming step of a job which is a series of image output operations for a single recording material or a plurality of recording materials by a single start instruction.

8. An image forming apparatus according to claim 7, wherein said processing portion acquires the current waveform in discharge and the voltage waveform in discharge in the second acquiring control by applying, to said charging member, oscillating voltages of at least two levels different in value of the AC voltage.

9. An image forming apparatus according to claim 1, wherein said processing portion executes the first acquiring control in a preparatory operation before an image forming step of a job which is a series of image current operations for a single recording material or a plurality of recording materials by a single start instruction, and executes the second acquiring control in a recording material interval step between the image forming step and a subsequent image forming step of the job.

10. An image forming apparatus according to claim 9, wherein said processing portion acquires the current waveform in discharge and the voltage waveform in discharge in the second acquiring control by applying, to said charging member, oscillating voltages of at least two levels different in value of the AC voltage.

11. An image forming apparatus according to claim 9, wherein said processing portion does not execute the second acquiring control in the preparatory operation.

12. An image forming apparatus according to claim 11, wherein said processing portion acquires the current waveform in discharge and the voltage waveform in discharge in the second acquiring control by applying, to said charging member, oscillating voltages of at least two levels different in value of the AC voltage.

13. An image forming apparatus according to claim 1, wherein said processing portion executes the first acquiring control in a preparatory operation before an image forming step of a job which is a series of image current operations for a single recording material or a plurality of recording materials by a single start instruction, and executes the second acquiring control in the image forming step, and wherein said controller carries out sequential control of the charging voltage, applied to said charging member, in the image forming step by using a result of the second acquiring control executed in the image forming step.

14. An image forming apparatus according to claim 13, wherein said processing portion does not execute the second acquiring control in the preparatory operation.

15. An image forming apparatus according to claim 1, wherein said processing portion makes a value of the DC voltage of the oscillating voltage applied to said charging member in the first acquiring control approximately 0 V.

16. An image forming apparatus according to claim 15, wherein said processing portion makes a value of the DC voltage of the oscillating voltage applied to said charging member in the second acquiring control a value of the same polarity as a charge polarity of the surface-to-be-charged.

17. An image forming apparatus according to claim 16, wherein said processing portion executes processing for removing, from the voltage waveform in discharge, a DC voltage component of the oscillating voltage applied to said charging member in the second acquiring control before or after the fast Fourier transformation of the voltage waveform in discharge.

* * * * *